US006074813A

United States Patent [19]

Asanuma et al.

[11] Patent Number: 6,074,813

[45] **Date of Patent: *Jun. 13, 2000**

[54] POLYHALOMETHANE COMPOUND AND PHOTOSENSITIVE MATERIAL

[75] Inventors: Naoki Asanuma; Hisashi Okada; Ichizo Toya, all of Minami Ashigara, Japan

[73] Assignee: Fuji Photo Film, Co., Ltd., Kanagawa, Japan

[ * ] Notice: This patent is subject to a terminal disclaimer.

[21] Appl. No.: 08/827,416

[22] Filed: Mar. 27, 1997

[30] Foreign Application Priority Data

Mar. 28, 1996 [JP] Japan ..... 8-097333

[51] Int. Cl.[7] ..... G03C 1/34

[52] U.S. Cl. ..... 430/613; 430/607; 430/619

[58] Field of Search ..... 430/617, 619, 430/607, 613, 614

[56] References Cited

U.S. PATENT DOCUMENTS 3,874,946 4/1975 Costa et al. .
4,756,999 7/1988 Swain et al. ..... 430/613
5,374,514 12/1994 Kirk et al. ..... 430/619
5,656,419 8/1997 Toya et al. ..... 430/619

*Primary Examiner*—Thorl Chea
*Attorney, Agent, or Firm*—Birch, Stewart, Kolasch & Birch, LLP

[57] ABSTRACT

A polyhalomethane compound represented by the following formula and a silver halide photosensitive material containing the same are disclosed.

($Q_1$ represents a 1,2,4-triazole ring, etc., $Z_1$ and $Z_2$ each represents a halogen atom, Y represents —$SO_2$—, etc., and A represents a halogen atom, etc.)

The polyhalomethane compound is useful as a highly active antifoggant which enables photosensitive materials, especially of the heat development type, to have excellent raw-stock storage stability and image storage stability when stored in a stacked state, without reducing sensitivity nor impairing color tone.

13 Claims, No Drawings

POLYHALOMETHANE COMPOUND AND PHOTOSENSITIVE MATERIAL

FIELD OF THE INVENTION

The present invention relates to a novel polyhalomethane compound and a photosensitive (photographic) material. More particularly, the present invention relates to a technique for providing an antifoggant with higher activity and improving the storage stability of photothermographic materials and of images formed thereon.

BACKGROUND OF THE INVENTION

Polyhalomethane compounds are used as photopolymerization initiators and in applications such as silver halide photographic materials. Conventionally known polyhalomethane compounds are disclosed in, e.g., JP-B-54-165 (the term "JP-B" as used herein means an "examined Japanese patent publication"), U.S. Pat. Nos. 3,874,946 and 4,756,999, EP-A-605,981, and EP-A-631,176. Examples of these known polyhalomethane compounds are shown below.

Comparative Compound a

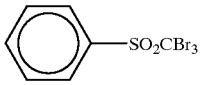

(disclosed in JP-B-54-165)

Comparative Compound b

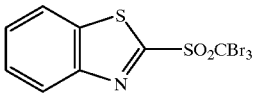

(disclosed in JP-B-54-165)

Comparative Compound c

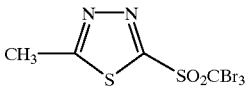

(disclosed in EP 605,981 A1)

Comparative Compound d

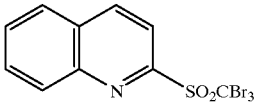

(disclosed in EP 631,176 A1)

On the other hand, photothermographic materials in which a photographic image is formed through heat development are disclosed, e.g., in U.S. Pat. Nos. 3,152,904 and 3,457,075 and in D. Morgan and B. Shely "Thermally Processed Silver Systems" (Imaging Processes and Materials, Neblette 8th ed., edited by Sturge, V. Walworth and A. Shepp, p. 2, 1969).

Such photothermographic materials contain a reducible silver salt (e.g., an organosilver salt), a catalytically effective amount of a photocatalyst (e.g., a silver halide), and a reducing agent, which all are usually dispersed in an (organic) binder matrix. The photothermographic materials are stable at ordinary temperature. Upon heating to a high temperature (e.g., 80° C. or higher) after exposure, the photosensitive materials undergo an oxidation-reduction reaction between the reducible silver source (which functions as an oxidizing agent) and the reducing agent to yield silver. This oxidation-reduction reaction is accelerated by the catalytic action of the latent image formed by exposure. The silver yielded by the reaction of the organosilver salt in the exposed areas provides a black image, which makes a contrast with the unexposed areas. Thus, an image is formed. These sensitive materials optionally contain a tone regulator for regulating the color tone of the silver image. Such image-forming systems are apt to suffer fogging.

Mercury ions are known to be the most effective antifoggant in the prior art fogging-preventive techniques. Use of a mercury compound as-an antifoggant in a photosensitive material is disclosed in, e.g., U.S. Pat. No. 3,589,903. However, since use of mercury compounds is undesirable from the standpoint of environmental protection, polyhalomethane compounds such as those specified above have been developed so far as mercury-free antifoggants.

Those prior art mercury-free compounds specified above, however, have problems in that they are less effective in fogging prevention or impair the color tone of silver, and that a high antifogging effect is obtainable with a sacrifice of sensitivity. The prior art compounds should be improved in these points. Further, photosensitive materials containing such a prior art compound have a problem in that when they are stored in a stacked state under high-temperature high-humidity forced aging conditions and then subjected to exposure and development, enhanced fogging occurs in the unexposed areas. There has hence been a desire for an antifoggant free from these problems.

SUMMARY OF THE INVENTION

An object of the present invention is to provide a more active antifogging to improve the raw-stock storage stability of stacked photosensitive materials, especially in photothermographic materials and improve the storage stability of images formed thereon, without reducing sensitivity nor impairing color tone.

Another object of the present invention is to provide a novel polyhalomethane compound useful as a photopolymerization initiator and in applications such as silver halide photographic materials.

The above objects are accomplished with the following means (1) to (5).

(1) A silver halide photosensitive material which contains a polyhalomethane compound represented by formula

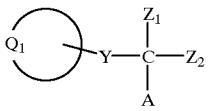

wherein $Q_1$ represents a five-membered unsaturated heterocycle comprising from two to four nitrogen atoms and at least one carbon atom; $Z_1$ and $Z_2$ each represents a halogen atom; Y represents —C(=O)—, —SO—, or —$SO_2$—; and A represents a hydrogen atom or an electron-withdrawing group.

(2) A photothermographic material which contains (a) a reducible silver salt, (b) a reducing agent, (c) a photocatalyst, (d) a binder, and (e) the polyhalomethane compound represented by formula (I) described in (1) above.

(3) The photothermographic material as described in (2) above, which is sensitized in the infrared region for exposure to infrared laser rays.

(4) A polyhalomethane compound represented by formula (I-a):

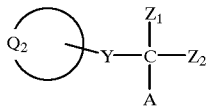

wherein $Q_2$ represents a five-membered unsaturated heterocycle comprising from three or four nitrogen atoms and at least one carbon atom; $Z_1$ and $Z_2$ each represents a halogen atom; Y represents —C(=O)—, —SO—, or —$SO_2$—; and A represents a hydrogen atom or an electron-withdrawing group.

(5) The polyhalomethane compound as described in (4) above, wherein in formula (I-a), $Q_2$ represents a 1,2,4-triazole ring, Y represents —$SO_2$—, and A represents a halogen atom.

DETAILED DESCRIPTION OF THE INVENTION

First, formula (I) is explained in detail.

The five-membered unsaturated heterocycle represented by $Q_1$, which comprises from two to four nitrogen atoms and at least one carbon atom, may form a fused ring together with other ring(s). Examples of the unsaturated heterocycle represented by Q, include imidazole, pyrazole, benzimidazole, indazole, purine, 1,2,4-triazole, 1,2,3-triazole, tetrazole, 1H-pyrazolo[1,5-b]-1,2,4-triazole, 1H-pyrazolo[5,1-c]-1,2,4-triazole, 1H-pyrrolo[1,2-b]-1,2,4-triazole, 1H-pyrrolo[2,1-c]-1,2,4-triazole, 1H-pyridyl[1,2-b]-1,2,4-triazole, and tetrazaindene. Desirable of these are five-membered unsaturated heterocycles comprising three or four nitrogen atoms and one or two carbon atoms, specifically 1,2,4-triazole and tetrazole. In particular, 1,2,4-triazole is preferred.

Although the five-membered unsaturated heterocycle represented by $Q_1$, which comprises from two to four nitrogen atoms and at least one carbon atom, is bonded to —Y through a carbon or nitrogen atom, it is preferably bonded through a carbon atom.

The five-membered unsaturated heterocycle represented by $Q_1$, which comprises two or more nitrogen atoms and at least one carbon atom, may have one or more substituents. Examples of the substituents include alkyl groups (having desirably 1 to 20, preferably 1 to 12, especially preferably 1 to 8 carbon atoms; e.g., methyl, ethyl, isopropyl, tert-butyl, n-octyl, n-decyl, n-hexadecyl, cyclopropyl, cyclopentyl, and cyclohexyl), alkenyl groups (having desirably 2 to 20, preferably 2 to 12, especially preferably 2 to 8 carbon atoms; e.g., vinyl, allyl, 2-butenyl, and 3-pentenyl), alkynyl groups (having desirably 2 to 20, preferably 2 to 12, especially preferably 2 to 8 carbon atoms; e.g., propargyl and 3-pentynyl), aryl groups (having desirably 6 to 30, preferably 6 to 20, especially preferably 6 to 12 carbon atoms; e.g., phenyl, p-methylphenyl, and naphthyl), amino groups (having desirably 0 to 20, preferably 0 to 10, especially preferably 0 to 6 carbon atoms; e.g., amino, methylamino, dimethylamino, diethylamino, and dibenzylamino), alkoxy groups (having desirably 1 to 20, preferably 1 to 12, especially preferably 1 to 8 carbon atoms; e.g., methoxy, ethoxy, and butoxy), aryloxy groups (having desirably 6 to 20, preferably 6 to 16, especially preferably 6 to 12 carbon atoms; e.g., phenyloxy and 2-naphthyloxy), acyl groups (having desirably 1 to 20, preferably 1 to 16, especially preferably 1 to 12 carbon atoms; e.g., acetyl, benzoyl, formyl, and pivaloyl), alkoxycarbonyl groups (having desirably 2 to 20, preferably 2 to 16, especially preferably 2 to 12 carbon atoms; e.g., methoxycarbonyl and ethoxycarbonyl), aryloxycarbonyl groups (having desirably 7 to 20, preferably 7 to 16, especially preferably 7 to 12 carbon atoms; e.g., phenyloxycarbonyl), acyloxy groups (having desirably 2 to 20, preferably 2 to 16, especially preferably 2 to 10 carbon atoms; e.g., acetoxy and benzoyloxy), acylamino groups (having desirably 2 to 20, preferably 2 to 16, especially preferably 2 to 10 carbon atoms; e.g., acetylamino and benzoylamino), alkoxycarbonylamino groups (having desirably 2 to 20, preferably 2 to 16, especially preferably 2 to 12 carbon atoms; e.g., methoxycarbonylamino), aryloxycarbonylamino groups (having desirably 7 to 20, preferably 7 to 16, especially preferably 7 to 12 carbon atoms; e.g., phenyloxycarbonylamino), sulfonylamino groups (having desirably 1 to 20, preferably 1 to 16, especially preferably 1 to 12 carbon atoms; e.g., methanesulfonylamino and benzenesulfonylamino), sulfamoyl groups (having desirably 0 to 20, preferably 0 to 16, especially preferably 0 to 12 carbon atoms; e.g., sulfamoyl, methylsulfamoyl, and dimethylsulfamoyl), carbamoyl groups (having desirably 1 to 20, preferably 1 to 16, especially preferably 1 to 12 carbon atoms; e.g., carbamoyl, methylcarbamoyl, diethylcarbamoyl, and phenylcarbamoyl), alkylthio groups (having desirably 1 to 20, preferably 1 to 16, especially preferably 1 to 12 carbon atoms; e.g., methylthio and ethylthio), arylthio groups (having desirably 6 to 20, preferably 6 to 16, especially preferably 6 to 12 carbon atoms; e.g., phenylthio), sulfinyl groups (having desirably 1 to 20, preferably 1 to 16, especially preferably 1 to 12 carbon atoms; e.g., methanesulfinyl and benzenesulfinyl), ureido groups (having desirably 1 to 20, preferably 1 to 16, especially preferably 1 to 12 carbon atoms; e.g., ureido, methylureido, and phenylureido), phosphoric acide amide groups (having desirably 1 to 20, preferably 1 to 16, especially preferably 1 to 12 carbon atoms; e.g., diethylphosphoric acid amide and phenylphosphoric acid amide), a hydroxy group, a mercapto group, halogen atoms (e.g., fluorine, chlorine, bromine, and iodine), a cyano group, a sulfo group, a carboxyl group, a nitro group, hydroxamic acid groups, a sulfino group, a hydrazino group, and heterocyclic groups (e.g., imidazolyl, pyridyl, furyl, piperidyl, and morpholino). These substituents may be substituted. In the case where the heterocycle represented by $Q_1$ has two or more substituents, these may be the same or different.

Desirable substituents are alkyl groups, alkenyl groups, alkynyl groups, aryl groups, alkoxy groups, aryloxy groups, acyloxy groups, acylamino groups, alkoxycarbonylamino groups, aryloxycarbonylamino groups, sulfonylamino groups, ureido groups, phosphoric acid amide groups, sulfinyl groups, hydroxy, and heterocyclic groups. Preferred substituents are alkyl groups, alkenyl groups, alkynyl groups, aryl groups, alkoxy groups, aryloxy groups, acylamino groups, alkoxycarbonylamino groups, aryloxycarbonylamino groups, sulfonylamino groups, ureido groups, phosphoric acid amide groups, and heterocyclic groups. Of these, alkyl groups, alkenyl groups, alkynyl groups, aryl groups, acylamino groups, sulfonylamino groups, ureido groups, phosphoric acid amide groups, and heterocyclic groups are even preferred, with alkyl, aryl, and heterocyclic groups being especially preferred.

The halogen atoms respectively represented by $Z_1$ and $Z_2$ may be the same or different, and each is a fluorine, chlorine, bromine, or iodine atom. $Z_1$ and $Z_2$ each is desirably a chlorine, bromine, or iodine atom, preferably a chlorine or bromine atom, and especially preferably a bromine atom.

Y represents —C(=O)—, —SO—, or —$SO_2$—, desirably —$SO_2$—.

The electron-withdrawing group represented by A is a substituent having a $\sigma_p$ value of desirably 0.01 or higher, preferably 0.1 or higher. With respect to Hammett's substituent constants, reference may be made to, e.g., *Journal of Medicinal Chemistry,* 1973, Vol, 16, No. 11, 1207–1216. Examples of the electron-withdrawing group include halogen atoms [fluorine ($\sigma_p$: 0.06), chlorine ($\sigma_p$: 0.23), bromine ($\sigma_p$: 0.23), iodine ($\sigma_p$: 0.18)], trihalomethyl groups [tribromomethyl ($\sigma_p$: 0.29), trichloromethyl ($\sigma_p$: 0.33), trifluoromethyl ($\sigma_p$: 0.54)], cyano ($\sigma_p$: 0.66), nitro ($\sigma_9$: 0.78), aliphatic, aryl, or heterocyclic sulfonyl groups [e.g., methanesulfonyl ($\sigma_p$: 0.72)], aliphatic, aryl, or heterocyclic acyl groups [e.g., acetyl ($\sigma_p$: 0.50), benzoyl ($\sigma_9$: 0.43)], alkynyl groups [e.g., ethynyl ($\sigma_p$: 0.23)], aliphatic, aryl, or heterocyclic oxycarbonyl groups [e.g., methoxycarbonyl ($\sigma_p$: 0.45), phenoxycarbonyl ($\sigma_p$: 0.44)], carbamoyl ($\sigma_p$: 0.36), and sulfamoyl ($\sigma_p$: 0.57).

Symbol A is desirably an electron-withdrawing group, preferably a halogen atom, an aliphatic, aryl, or heterocyclic sulfonyl group, an aliphatic, aryl, or heterocyclic acyl group, an aliphatic, aryl, or heterocyclic oxycarbonyl group, carbamoyl, or sulfamoyl, and is especially preferably a halogen atom. The halogen atom is desirably chlorine, bromine, or iodine, preferably chlorine or bromine, especially preferably bromine.

Desirable of the compounds represented by formula (I) are those represented by formula (I-a).

Formula (I-a)

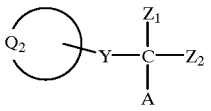

In formula (I-a), $Q_2$ represents a five-membered unsaturated heterocycle comprising three or four nitrogen atoms and at least one carbon atom, and can have the same substituents as $Q_1$. Further, A, Y, $Z_1$, and $Z_2$ respectively have the same meanings and same preferred ranges as those in formula (I).

Preferred of the compounds represented by formula (I) are those represented by formula (I-b) or (I-c), especially preferably by formula (I-b).

Formula (I-b)

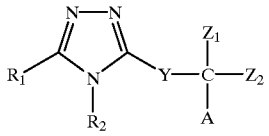

Formula (I-c)

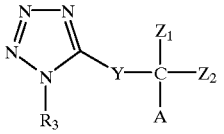

In formulae (I-b) and (I-c), A, Y, $Z_1$, and $Z_2$ respectively have the same meanings and same preferred ranges as those in formula (I). $R_1$, $R_2$, and $R_3$ each represents a substituent, and have the same meanings as the substituents which Q, in formula (I) can have.

Desirable examples of R, include a hydrogen atom, alkyl groups, alkenyl groups, alkynyl groups, aryl groups, alkoxy groups, aryloxy groups, acyloxy groups, acylamino groups, alkoxycarbonylamino groups, aryloxycarbonylamino groups, sulfonylamino groups, ureido groups, phosphoric acid amide groups, and heterocyclic groups. Preferred examples thereof are a hydrogen atom, alkyl groups, alkenyl groups, alkynyl groups, aryl groups, alkoxy groups, aryloxy groups, acylamino groups, alkoxycarbonylamino groups, aryloxycarbonylamino groups, sulfonylamino groups, ureido groups, phosphoric acid amide groups, and heterocyclic groups. Even preferred of these are a hydrogen atom, alkyl groups, alkenyl groups, alkynyl groups, aryl groups, acylamino groups, sulfonylamino groups, ureido groups, phosphoric acid amide groups, and heterocyclic groups. Especially preferred of these are a hydrogen atom, alkyl groups, aryl groups, and heterocyclic groups, in particular a hydrogen atom and alkyl groups.

Desirable examples of $R_2$ and $R_3$ include alkyl groups, alkenyl groups, alkynyl groups, aryl groups, alkoxy groups, aryloxy groups, acyloxy groups, acylamino groups, alkoxycarbonylamino groups, aryloxycarbonylamino groups, sulfonylamino groups, ureido groups, phosphoric acid amide groups, and heterocyclic groups. Preferred examples thereof are alkyl groups, alkenyl groups, alkynyl groups, aryl groups, alkoxy groups, aryloxy groups, acylamino groups, alkoxycarbonylamino groups, aryloxycarbonylamino groups, sulfonylamino groups, ureido groups, phosphoric acid amide groups, and heterocyclic groups. Even preferred of these are alkyl groups, alkenyl groups, alkynyl groups, aryl groups, acylamino groups, sulfonylamino groups, ureido groups, phosphoric acid amide groups, and heterocyclic groups. Especially preferred of these are alkyl groups, aryl groups, and heterocyclic groups.

Especially preferred of the compounds represented by formula (I-b) are those represented by formula (I-d).

Formula (I-d)

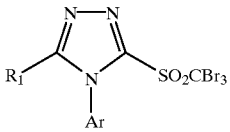

In formula (I-d), $R_1$ has the same meaning and same preferred range as that in formula (I-b). Ar represents an aryl group, desirably phenyl or naphthyl, and preferably phenyl. The aryl group represented by Ar may have one or more substituents, examples of which include the same substituents which $Q_1$ in formula (I) can have.

Specific examples of the compound represented by formula (I) are given below, but the compound for use in the present invention should not be construed as being limited thereto.
I-1
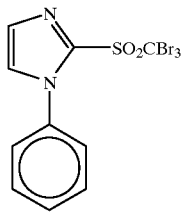
I-2
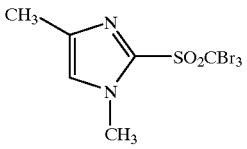
I-3
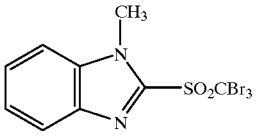
I-4
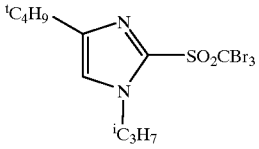
I-5
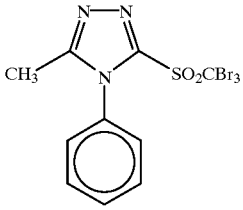
I-6
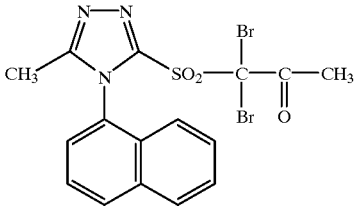
I-7
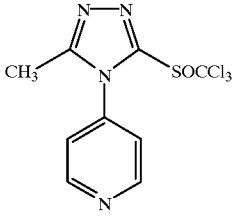
-continued
I-8
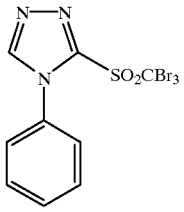
I-9
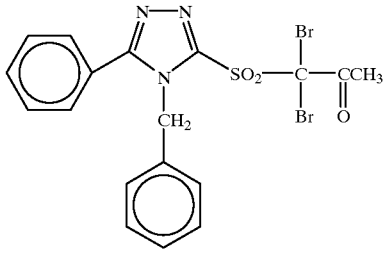
I-10
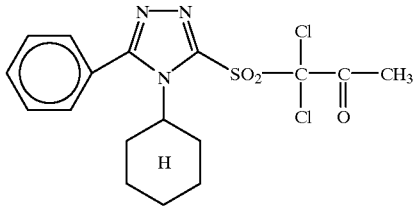
I-11
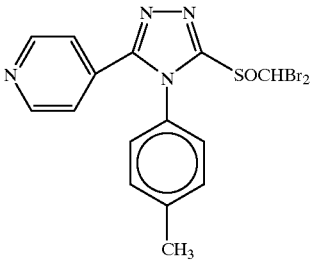
I-12
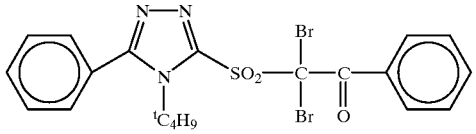
I-13
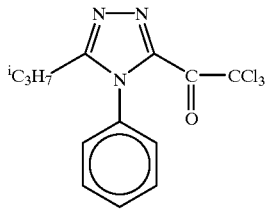
I-14
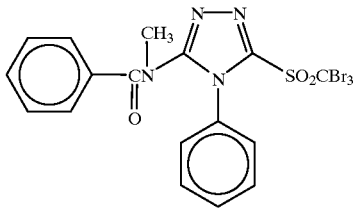

-continued
I-15
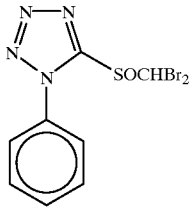
I-16
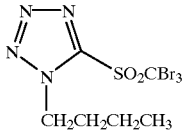
I-17
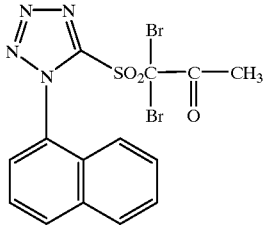
I-18
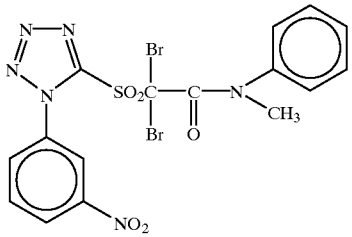
I-19
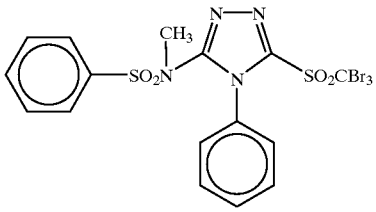
I-20
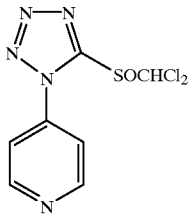
I-21
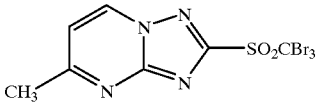
I-22
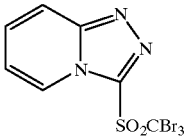
-continued
I-23
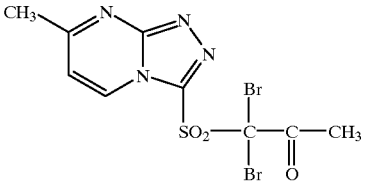
I-24
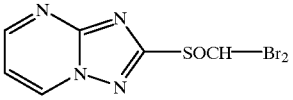
I-25
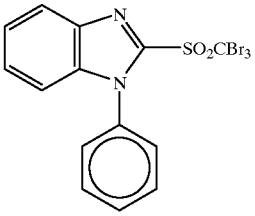
I-26
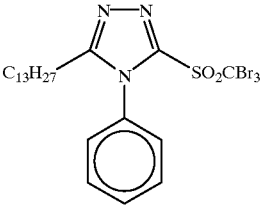
I-27
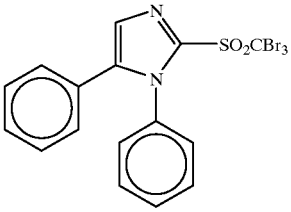
I-28
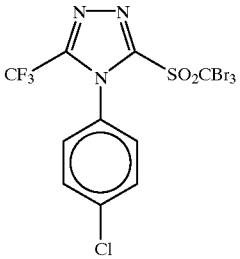
I-29
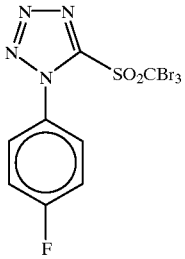

-continued
I-30
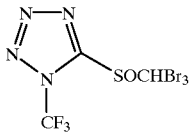
I-31
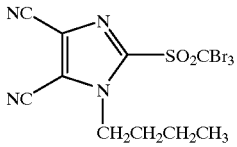
I-32
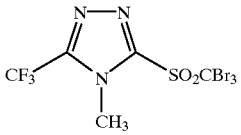
I-33
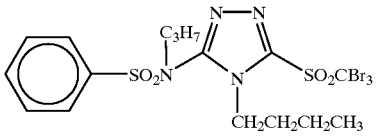
I-34
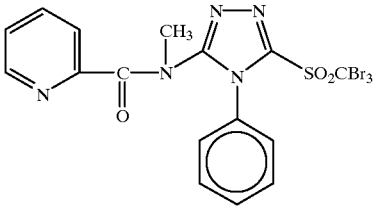
I-35
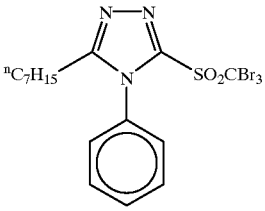
I-36
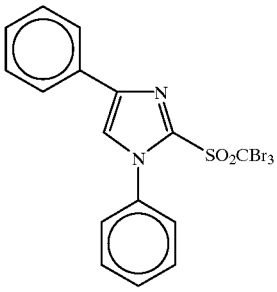
I-37
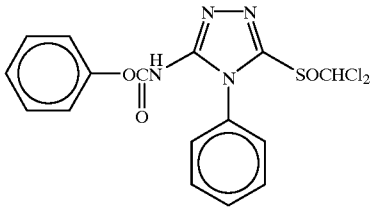
-continued
I-38
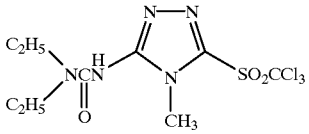
I-39
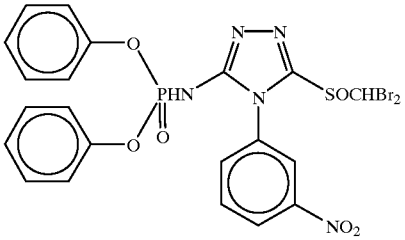
I-40
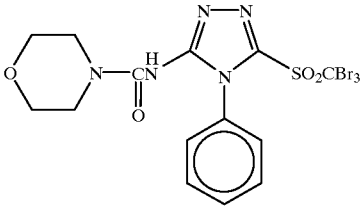
I-41
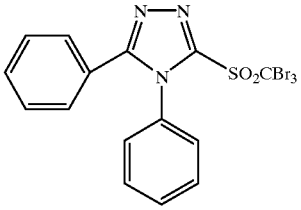
I-42
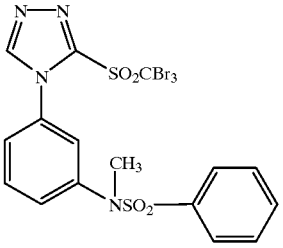
I-43
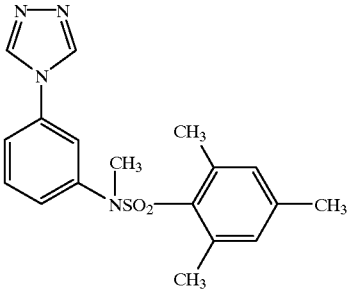

-continued

I-44

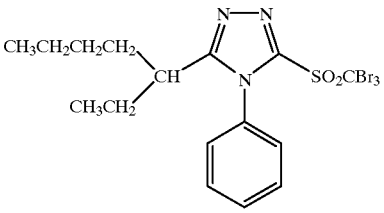

I-45

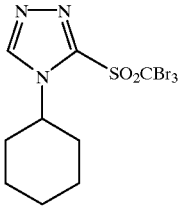

I-46

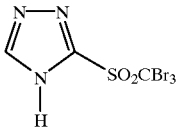

I-47

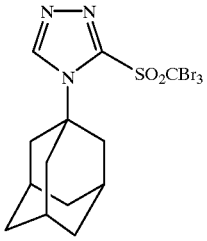

I-48

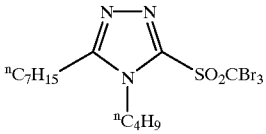

I-49

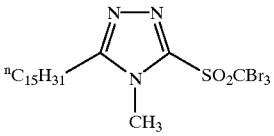

I-50

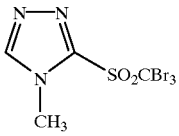

I-51

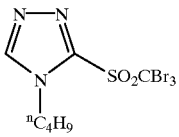

I-52

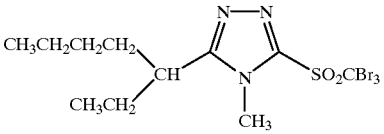

-continued

I-53

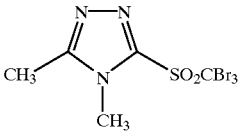

I-54

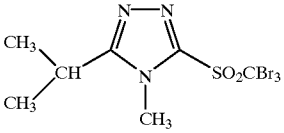

I-55

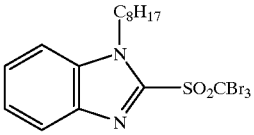

In the case where Y in formula (I) is —SO— or —$SO_2$—, the compound represented by formula (I) of the present invention can be synthesized by (1) synthesizing a mercaptoazole derivative, (2) converting the mercaptoazole derivative into a mercaptoacetic acid derivative, and (3) oxidizing and brominating the mercaptoacetic acid derivative.

For synthesizing the mercaptoazole derivative, use may be made of the method described in, e.g., "Shin Jikken Kagaku Kōza (Lectures on New Experimental Chemistry)," 14-IV, Chap. 9, 9-3 and 9-4 (Maruzen).

For example, a 2-mercaptoimidazole derivative can be synthesized by reacting an α-aminocarbonyl compound or a precursor thereof with a salt of thiocyanic acid.

A 3-mercapto-1,2,4-triazole derivative can be synthesized by reacting the corresponding thiosemicarbazide with a carbonyl halide, isocyanate, halogenoformic ester, carbon disulfide, etc., and subjecting the reaction product to dehydrating ring closure under acid or basic conditions. Alternatively, the desired compound can be synthesized by reacting a thioisocyanate derivative with an acylhydrazide derivative and subjecting the reaction product to dehydrating ring closure under acid or basic conditions.

A 5-mercaptotetrazole derivative can be synthesized by reacting the corresponding thioisocyanate derivative with an azide salt.

Such a mercaptoheterocyclic compound can be converted to a mercaptoacetic acid derivative by reacting the same with chloroacetic acid or a salt thereof under basic conditions.

For the oxidation and halogenation of the mercaptoacetic acid derivative, the method described in, e.g., U.S. Pat. No. 3,874,946 and EP-A-60,598 may be used. In this method, the mercaptoacetic acid derivative or a salt thereof is added to and reacted with a basic aqueous solution of either a hypohalogenous acid or a salt thereof, whereby the oxidation and halogenation can be conducted simultaneously. Alternatively, the target compound may be synthesized by converting the mercaptoacetic acid derivative into a sulfoxide or a sulfonylacetic acid derivative with an oxidizing agent, e.g., hydrogen peroxide, and then halogenating the sulfoxide or sulfonylacetic acid derivative.

In the case where Y is —C(=O)—, the compound represented by formula (I) can be synthesized by (1) synthesizing a 3-carbonyl-substituted azole derivative and (2) halogenating the carbonyl compound.

For synthesizing the carbonyl-substituted azole derivative, use may be made of the method described in, e.g., "Shin Jikken Kagaku Kōza (Lectures on New Experimental Chemistry)," 14-IV, Chap. 9, 9-3 and 9-4 (Maruzen).

The halogenation can be conducted by a method such as that described in, e.g., "Shin Jikken Kagaku Kōza (Lectures on New Experimental Chemistry)," 14-I, Chap. 2 (Maruzen).

Typical synthesis examples for compounds represented by formula (I) are given below.

SYNTHESIS EXAMPLE

Synthesis of Compound I-8

(1) Synthesis of 4-Phenyl-3-mercapto-1,2,4-triazole

A 334 g (2 mol) portion of phenylthiosemicarbazide was dissolved into 600 ml of 90% formic acid which had been heated at 100° C. for 15 minutes. The solution was heated for 30 minutes to react the reactants. To the reaction mixture was added 900 ml of boiling water. This solution was filtered, allowed to stand for 1 hour, and then cooled with ice water for 2 hours. The crystals thus precipitated were taken out by filtration and dried under vacuum to obtain a formylated compound. Into 1 l of water were dissolved 292.9 g (1.5 mol) of the formylated compound and 64.5 g (1.5 mol) of sodium hydroxide (purity, 93%). This solution was heated at 100° C. for 1 hour to react the reactants, cooled with ice water for 30 minutes, subsequently treated with 150 ml of concentrated hydrochloric acid, and then cooled with ice water for 2 hours. The resulting precipitate was taken out by suction filtration, and then recrystallized from 800 ml of water to obtain 202 g (1.14 mol) of the desired triazole. Yield, 76%.

(2) Synthesis of 3-Carboxymethylthio-4-phenyl-1,2,4-triazole

Into 500 ml of ethanol were suspended 53 g (0.3 mol) of 4-phenyl-3-mercapto-1,2,4-triazole and 44.1 g (0.36 mol) of sodium chloroacetate. Thereto was added an aqueous solution prepared by dissolving 15.5 g (0.36 mol) of sodium hydroxide (purity, 93%) into 60 ml of water. This mixture was kept at 50° C. for 3 hours to-react the reactants. The reaction mixture was allowed to cool to room temperature, neutralized by dropwise adding 31 ml (0.36 mol) of concentrated hydrochloric acid, and then cooled to 10° C. or lower with ice. The resulting precipitate was taken out by filtration. To the precipitate was added 1.5 l of ethanol. This mixture was heated, and the insoluble matter was taken out by filtration. Thereafter recrystallization was conducted with cooling to obtain 32.3 g (0.14 mol) of the desired mercaptoacetic acid derivative. Yield, 45.8%.

(3) Synthesis of Compound I-8

Into 900 ml of water was dissolved 35 g (0.808 mol) of sodium hydroxide (purity, 93%). After this solution was cooled to 10° C. or lower, 22 ml (0.427 mol) of bromine was added dropwise thereto. A solution prepared by dissolving 11.8 g (0.05 mol) of the mercaptoacetic acid derivative obtained in (2) above and 4.6 g (0.055 mol) of sodium hydrogen carbonate into 100 ml of water was added dropwise to the thus-obtained mixture with stirring over a period of 1 hour while the temperature of the reaction system was kept at 5° C. or lower. After completion of the addition, the temperature of the reaction mixture was gradually returned to room temperature with stirring. This reaction mixture was allowed to stand overnight, and the resulting precipitate was taken out by filtration, sufficiently washed with water and dried, and then recrystallized from ethanol to obtain 5.68 g (0.012 mol) of Compound I-8 as the target compound. Yield, 24.7%. Melting point, 174–176° C. (decomposed).

SYNTHESIS EXAMPLE

Synthesis of Compound I-35

(1) Synthesis of 4-Phenyl-3-mercapto-5-heptyl-1,2,4-triazole

Into 800 ml of tetrahydrofuran was suspended 83.6 g (0.5 mol) of 4-phenyl-3-thiosemicarbazide. Thereto was added 76.7 ml (0.55 mol) of triethylamine. While this mixture was kept being cooled at 10° C. or lower with ice, 89.5 g (0.55 mol) of capryloyl chloride was added dropwise thereto. After completion of the addition, the reaction mixture was continuously stirred for 3 hours, and the temperature thereof was then returned to room temperature. Thereafter, 2.5 l of water was added to the reaction mixture, and the resulting precipitate was taken out by filtration.

Subsequently, 117.4 g (0.4 mol) of the precipitate obtained above was added to a solution prepared by dissolving 51.6 g (1.2 mol) of sodium hydroxide (purity, 93%) into 450 ml of water. This reaction mixture was heated at 100° C. for 1 hour to react the reactants, cooled with ice water for 30 minutes, and then treated with 103 ml of concentrated hydrochloric acid. The resulting precipitate was taken out by suction filtration and recrystallized from 800 ml of ethanol to obtain 74.2 g ( 0.27 mol) of the desired triazole. Yield, 67%.

(2) Synthesis of 3-(N-Phenyl-5-heptyl-1,2,4-triazolyl) thioacetic Acid

Into 500 ml of ethanol were suspended 74.2 g (0.27 mol) of 4-phenyl-3-mercapto-5-heptyl-1,2,4-triazole and 44.1 g (0.36 mol) of sodium chloroacetate. Thereto was added an aqueous solution prepared by dissolving 15.5 g (0.36 mol) of sodium hydroxide (purity, 93%) into 100 ml of water. This mixture was kept at 50° C. for 3 hours to react the reactants. The reaction mixture was allowed to cool to room temperature, neutralized by dropwise adding thereto 31 ml (0.36 mol) of concentrated hydrochloric acid, and then cooled to 10° C. or lower with ice. The resulting precipitate was taken out by filtration, washed with water, and then dried under vacuum to obtain 78.7 g (0.24 mol) of the desired mercaptoacetic acid derivative. Yield, 88.0%.

(3) Synthesis of Compound I-35

Into 1.8 e of water was dissolved 70 g (1.6 mol) of sodium hydroxide (purity, 93%). After this solution was cooled to 10° C. or lower, 44 ml (0.854 mol) of bromine was added dropwise thereto. A solution prepared by dissolving 27.5 g (0.08 mol) of the mercaptoacetic acid derivative obtained in (2) above and 9.2 g (0.11 mol) of sodium hydrogen carbonate into 700 ml of water was added dropwise to the thus-obtained mixture with stirring over a period of 3 hours while the temperature of the reaction system was kept at 5° C. or lower. After completion of the addition, the temperature of the reaction mixture was gradually returned to room temperature with stirring. This reaction mixture was allowed to stand overnight, and the resulting precipitate was taken out by filtration, sufficiently washed with water and dried, and then recrystallized from ethanol to obtain 22.2 g (0.040 mol) of Compound I-35 as the target compound. Yield, 49.7%. Melting point, 121–123° C.

SYNTHESIS EXAMPLE

Synthesis of Compound I-41

(1) Synthesis of 4,5-diphenyl-3-mercapto-1,2,4-triazole

A 68.1 g (0.5 mol) portion of benzoyl hydrazine was suspended into 500 ml of acetonitrile, and then cooled with ice. To the suspension was then added dropwise 74.4 g (0.55 mol) of phenyl isothiocyanate. After completion of the dropwise addition, the temperature of the reaction solution was gradually returned to room temperature. The reaction solution was then allowed to stand overnight. To the reaction solution was then added 2 l of water. The resulting precipitate was withdrawn by filtration.

A 108.5 g (0.4 mol) portion of the precipitate was then added to a solution of 51.6 g (1.2 mol) of sodium hydroxide (purity: 93%) in 450 ml of water. The reaction solution was then heated to a temperature of 100° C. for 1 hour. The reaction solution was poured into ice water which was then treated with 103 ml of concentrated hydrochloric acid. The resulting precipitate was withdrawn by suction filtration, washed with water, and then dried to obtain 58.5 g (0.23 mol) of the desired triazole (yield: 57.7%).

(2) Synthesis of 3-carboxylmethylthio-4,5-diphenyl-1,2,4-triazole

Into 500 ml of ethanol were suspended 62 g (0.245 mol) of 4,5-diphenyl-3-mercapto-1,2,4-triazole and 45.1 g (0.368 mol) of sodium chloroacetate. Thereto was added an aqueous solution prepared by dissolving 15.8 g (0.37 mol) of sodium hydroxide (purity: 93%) into 60 ml of water. The reaction mixture was then allowed to undergo reaction at a temperature of 50° C. for 3 hours. The reaction solution was allowed to cool to room temperature, neutralized by dropwise addition of 31.5 ml of concentrated hydrochloric acid, and then allowed to stand overnight. The resulting precipitate was withdrawn by filtration, washed with water, and then dried to obtain 68.5 g (0.22 mol) of the desired mercaptoacetic acid derivative (yield: 89.8%).

(3) Synthesis of Compound I-41

Into 1.8 l of water was dissolved 70 g (1.6 mol) of sodium hydroxide (purity: 93%). After this solution was cooled to 10° C. or lower, 44 ml (0.854 mol) of bromine was added dropwise thereto. To the reaction solution thus prepared was then gradually added dropwise a solution prepared by dissolving 31.1 g (0.1 mol) of the mercaptoacetic acid derivative obtained in the foregoing process (2) and 9.2 g (0.11 mol) of sodium hydrogencarbonate into a mixture of 300 ml of 1,4-dioxane and 500 ml of water with stirring over a period of 1 hour while the temperature of the reaction system was kept at 5° C. or lower. After completion of the dropwise addition, the temperature of the reaction solution was gradually raised to 50° C. with stirring. The reaction solution was stirred at the same temperature for about 3 hours until the foaming of the reaction solution was suspended, and then allowed to stand at room temperature overnight. The resulting precipitate was withdrawn by filtration, thoroughly washed with water and dried, and then recrystallized from ethanol to obtain 12.7 g (0.023 mol) of Compound I-41 as the target compound (yield: 23.7%; melting point: 179–185° C.).

SYNTHESIS EXAMPLE

Synthesis of Compound I-26

(1) Synthesis of 3-mercapto-4-phenyl-5-tridecyl-1,2,4-triazole

Into 600 ml of tetrahydrofuran was suspended 51 g (0.305 mol) of 4-phenyl-3-thiosemicarbazide. To the suspension was then added 46 ml (0.33 mol) of triethylamine. While this mixture was kept being cooled at 10° C. or lower with ice, 75.3 g (0.305 mol) of myristic acid chloride was added dropwise thereto. After completion of the dropwise addition, the reaction mixture was continuously stirred for 3 hours, and the temperature thereof was then returned to room temperature. Thereafter, 2.5 l of water was added to the reaction solution. The resulting precipitate was withdrawn by filtration.

Subsequently, 110 g (0.29 mol) of the precipitate obtained above was added to a solution prepared by dissolving 40 g (0.93 mol) of sodium hydroxide (purity: 93%) into 360 ml of water. The reaction solution was then heated to a temperature of 100° C. for 1 hour to undergo reaction. The reaction solution was allowed to cool to room temperature where it was then treated with 128 ml of concentrated hydrochloric acid. The resulting precipitate was withdrawn by suction filtration, washed with water, and then dried to obtain 102 g (0.28 mol) of the desired triazole (yield: 98%).

(2) Synthesis of 3-carboxylmethylthio-4-phenyl-5-tridecyl-1,2,4-triazole

Into 600 ml of ethanol were suspended 100 g (0.278 mol) of 3-mercapto-4-phenyl-5-tridecyl-1,2,4-triazole and 44.1 g (0.36 mol) of sodium chloroacetate. Thereto was added an aqueous solution prepared by dissolving 15.5 g (0.36 mol) of sodium hydroxide (purity: 93%) in 150 ml of water. The reaction mixture was then allowed to undergo reaction at a temperature of 50° C. for 3 hours. The reaction solution was allowed to cool to room temperature, neutralized by dropwise addition of 31.5 ml of concentrated hydrochloric acid, and then allowed to stand overnight. The resulting precipitate was withdrawn by filtration, washed with water, and then dried to obtain 79.2 g (0.19 mol) of the desired mercaptoacetic acid derivative (yield: 68.7%).

(3) Synthesis of Compound I-26

Into 1.8 l of water was dissolved 70 g (1.6 mol) of sodium hydroxide (purity: 93%). After this solution was cooled to 10° C. or lower, 44 ml (0.854 mol) of bromine was added dropwise thereto. To the reaction solution thus prepared was then gradually added dropwise a solution prepared by dissolving 42 g (0.1 mol) of the mercaptoacetic acid derivative obtained in the foregoing process (2) and 9.2 g (0.11 mol) of sodium hydrogencarbonate into a mixture of 300 ml of 1,4-dioxane and 500 ml of water with stirring over a period of 3 hours while the temperature of the reaction system was kept at 5° C. or lower. After completion of the dropwise addition, the temperature of the reaction solution was gradually raised to 50° C. with stirring. The reaction solution was stirred at the same temperature for about 18 hours until the foaming of the reaction solution was suspended, and then allowed to stand at room temperature overnight. The resulting precipitate was withdrawn by filtration, thoroughly washed with water and dried, and then recrystallized from ethanol to obtain 20.2 g (0.031 mol) of Compound I-26 as the target compound (yield: 31.5%; melting point: 96° C.).

SYNTHESIS EXAMPLE

Synthesis of Compound I-5

(1) Synthesis of 3-mercapto-4-phenyl-5-methyl-1,2,4-triazole

Into 800 ml of tetrahydrofuran was suspended 83.6 g (0.5 mol) of 4-phenyl-3-thiosemicarbazide. To the suspension was then added 76.7 ml (0.55 mol) of triethylamine. While this mixture was kept being cooled at 10° C. or lower with ice, 43.1 g (0.55 mol) of acetyl chloride was added dropwise thereto. After completion of the dropwise addition, the reaction mixture was continuously stirred for 3 hours, and the temperature thereof was then returned to room temperature. Thereafter, 4 l of water and 150 g of sodium chloride were added to the reaction solution. The resulting precipitate was withdrawn by filtration.

Subsequently, the precipitate obtained above was added to a solution prepared by dissolving 64.5 g (1.5 mol) of sodium hydroxide (purity: 93%) into 550 ml of water. The reaction solution was then heated to a temperature of 100° C. for 1 hour to undergo reaction. The reaction solution was allowed to cool to room temperature where it was then treated with 128 ml of concentrated hydrochloric acid. The resulting precipitate was withdrawn by suction filtration, washed with water, and then dried to obtain 53 g (0.28 mol) of the desired triazole (yield: 55.4%).

(2) Synthesis of 3-carboxylmethylthio-4-phenyl-5-methyl-1,2,4-triazole

Into 400 ml of ethanol were suspended 52.9 g (0.28 mol) of 3-mercapto-4-phenyl-5-methyl-1,2,4-triazole and 41.2 g (0.34 mol) of sodium chloroacetate. To the suspension was added an aqueous solution prepared by dissolving 14.5 g (0.34 mol) of sodium hydroxide (purity: 93%) in 150 ml of water. The reaction mixture was then allowed to undergo reaction at a temperature of 50° C. for 3 hours. The reaction solution was allowed to cool to room temperature, neutralized by dropwise addition of 28.8 ml of concentrated hydrochloric acid, and then allowed to stand overnight. The resulting precipitate was withdrawn by filtration, washed with water, and then dried to obtain 39 g (0.16 mol) of the desired mercaptoacetic acid derivative (yield: 56%).

(3) Synthesis of Compound I-5

Into 1.8 l of water was dissolved 70 g (1.6 mol) of sodium hydroxide (purity: 93%). After this solution was cooled to 10° C. or lower, 44 ml (0.854 mol) of bromine was added dropwise thereto. To the reaction solution thus prepared was then gradually added dropwise a solution prepared by dissolving 25 g (0.1 mol) of the mercaptoacetic acid derivative obtained in the foregoing process (2) and 9.2 g (0.11 mol) of sodium hydrogencarbonate into 300 ml of water with stirring over a period of 3 hours while the temperature of the, reaction system was kept at 5° C. or lower. After completion of the dropwise addition, the temperature of the reaction solution was gradually returned to room temperature with stirring. The reaction solution was then allowed to stand at room temperature overnight. The resulting precipitate was withdrawn by filtration, thoroughly washed with water and dried, and then recrystallized from a mixture of ethanol and acetonitrile to obtain 21.9 g (0.046 mol) of Compound I-5 as the target compound (yield: 46.2%; melting point: 184–185° C.).

SYNTHESIS EXAMPLE

Synthesis of Compound I-42

(1) Synthesis of 3-mercapto-4-(3-aminophenyl)-1,2,4-triazole

Into 300 ml of acetonitrile was suspended 30 g (0.5 mol) of formyl hydrazine. To the suspension was then added 96.1 g (0.5 mol) of 3-acetylaminophenyl isothiocyanate. After completion of the dropwise addition, the temperature of the reaction solution was then gradually returned to room temperature. Thereafter, the reaction solution was heated to a temperature of 50° C. for 3 hours to undergo reaction, and then allowed to stand overnight. As a result, the reaction product was solidified. The reaction product was then withdrawn by suction filtration to remove the solvent.

Subsequently, the precipitate obtained above was added to a solution prepared by dissolving 64.5 g (1.5 mol) of sodium hydroxide (purity: 93%) into 600 ml of water. The reaction solution was then heated to a temperature of 100° C. for 1 hour to undergo reaction. The reaction solution was poured into ice water which was then treated with 130 ml of concentrated hydrochloric acid. The resulting precipitate was withdrawn by suction filtration, washed with water, and then dried. The resulting crude reaction product was dissolved in methanol. The insoluble matters were then removed by filtration. The filtrate was then concentrated to obtain 23.5 g (0.12 mol) of the desired triazole (yield: 24.4%).

(2) Synthesis of 3-mercapto-4-(3-benzenesulfonylamino phenyl)-1,2,4-triazole

Into 50 ml of dimethylacetamide was dissolved 9.6 g (50 mmol) of the triazole obtained in the foregoing process (1). To the solution was then added 8.8 g (50 mmol) of benzenesulfonyl chloride. The reaction mixture was then allowed to undergo reaction at a temperature of 50° C. for 4 hours. The reaction solution was poured into 500 ml of ice water. The resulting precipitate was withdrawn by filtration, and then washed with water to obtain the target compound. The crude reaction product thus obtained was then used undried at the subsequent step.

(3) Synthesis of 3-carboxylmethylthio-4-(3-benzenesulfonyl aminophenyl)-1,2,4-triazole Into 300 ml of ethanol were suspended the whole part (50 mmol) of the crude reaction product obtained in the foregoing process (2) and 9.2 g of sodium chloroacetate. To the suspension was then added an aqueous solution prepared by dissolving 3.2 g (75 mmol) of sodium hydroxide (purity: 93%) in 10 ml of water. The reaction mixture was allowed to undergo reaction at a temperature of 50° C. for 6 hours, and then allowed to stand overnight. The reaction solution was neutralized by dropwise addition of 6.5 ml of concentrated hydrochloric acid. The resulting precipitate was withdrawn by filtration, washed with water, and then dried to obtain 13.1 g (33.6 mmol) of the desired mercaptoacetic acid derivative (yield: 67%).

(4) Synthesis of 3-methyloxycarbonylmethylthio-4-[3-(N-methyl-N-benzenesulfonyl)aminophenyl]-1,2,4-triazole Into 50 ml of methanol was dissolved 11.7 g (30 mmol) of the mercaptoacetic acid derivative obtained in the foregoing process (3). To the solution was then added 12.7 g (66 mmol) of a 28% solution of sodium methoxide. The reaction solution was then subjected to evaporation by an evaporator to remove the solvent to dryness. To the material thus dried was added 30 ml of dimethylformamide to make a solution to which 9.4 g (66 mmol) of methyl iodide was then added. The reaction solution was allowed to undergo reaction at a temperature of 40° C. for 3 hours, and then allowed to stand overnight. To the reaction solution were then added ethyl acetate and water. The resulting organic phase was extracted, dried, and then concentrated to obtain 10.6 g of the desired compound in the form of oil (yield: 84%).

(5) Synthesis of 3-carboxylmethylthio-4-[3-(N-methyl-N-benzenesulfonyl)aminophenyl]-1,2,4-triazole Into 100 ml of methanol was dissolved 10.6 g (25 mmol) of the oil obtained in the foregoing process (4). To the solution was then added a solution prepared by dissolving 1.5 g (30 mmol) of sodium hydroxide (purity: 93%) in 20 ml of water. The reaction mixture was then allowed to undergo reaction at room temperature for 1 day. To the reaction solution was then added concentrated hydrochloric acid to adjust the pH value thereof to 3. The resulting precipitate was then withdrawn by filtration.

The precipitate was then recrystallized from a mixture of methanol and water to obtain 10.1 g (25 mmol) of the desired compound (yield: 100%).

(6) Synthesis of Compound I-42

Into 600 ml of water was dissolved 21 g (0.49 mol) of sodium hydroxide (purity: 93%). The solution was then cooled to a temperature of not higher than 10° C. To the solution was then added dropwise 13 ml (0.25 mol) of bromine. To the reaction solution thus prepared was then gradually added dropwise a solution prepared by dissolving 9.3 g (23 mmol) of the mercaptoacetic acid derivative obtained in the foregoing process (5) and 2.3 g (28 mmol) of sodium hydrogencarbonate into a mixture of 30 ml of 1,4-dioxane and 200 ml of water with stirring over a period of 1 hour while the temperature of the reaction system was kept at 5° C. or lower. After completion of the dropwise addition, the temperature of the reaction solution was gradually returned to room temperature with stirring. The reaction solution was then allowed to undergo reaction at the same temperature for 2 days. The resulting precipitate was withdrawn by filtration, thoroughly washed with water and dried, and then recrystallized from a mixture of ethanol and acetonitrile to obtain 6.8 g (11 mmol) of Compound I-42 as the target compound (yield: 46.9%; melting point: 189–190° C.).

SYNTHESIS EXAMPLE

Synthesis of Compound I-43

(1) Synthesis of 3-mercapto-4-(3-mesitylenesulfonyl aminophenyl)-1,2,4-triazole

Into 50 ml of dimethylacetamide was dissolved 9.6 g (50 mmol) of the triazole derivative obtained in the foregoing process (1) of Synthesis Example I-42. To the solution was then added 10.9 g (50 mmol) of mesitylenesulfonyl chloride. The reaction mixture was then allowed to undergo reaction at a temperature of 50° C. for 4 hours. The reaction solution was then poured into 500 ml of ice water. The resulting precipitate was withdrawn by filtration, and then washed with water to obtain the desired compound. The crude reaction product thus obtained was then used undried at the subsequent step.

(2) Synthesis of 3-carboxylmethylthio-4-(3-mesitylene sulfonylaminophenyl)-1,2,4-triazole Into 300 ml of ethanol were suspended the whole part (50 mmol) of the crude reaction product obtained in the foregoing process (1) and 9.2 g of sodium chloroacetate. To the suspension was then added an aqueous solution prepared by dissolving 3.2 g (75 mmol) of sodium hydroxide (purity: 93%) in 10 ml of water. The reaction mixture was allowed to undergo reaction at a temperature of 50° C. for 6 hours, and then allowed to stand overnight. The reaction solution was neutralized by dropwise addition of 6.5 ml of concentrated hydrochloric acid. The resulting precipitate was withdrawn by filtration, washed with water, and then dried to obtain 14.8 g (34.4 mmol) of the desired mercaptoacetic acid derivative (yield: 69%).

(3) Synthesis of 3-methyloxycarbonylmethylthio-4-[3-(N-methyl-N-mesitylenesulfonyl)aminophenyl]-1,2,4-triazole Into 50 ml of methanol was dissolved 13 g (30 mmol) of the mercaptoacetic acid derivative obtained in the foregoing process (2). To the solution was then added 12.7 g (66 mmol) of a 28% solution of sodium methoxide. The reaction solution was then subjected to evaporation by an evaporator to remove the solvent to dryness. To the material thus dried was added 30 ml of dimethylformamide to make a solution to which 9.4 g (66 mmol) of methyl iodide was then added. The reaction solution was allowed to undergo reaction at a temperature of 40° C. for 3 hours, and then allowed to stand overnight. To the reaction solution were then added water. The resulting precipitate was withdrawn by filtration, washed with water, and then dried to obtain 10.3 g of the desired compound (yield: 74.6%).

(4) Synthesis of 3-carboxylmethylthio-4-[3-(N-methyl-N-mesitylenesulfonyl)aminophenyl]-1,2,4-triazole Into 100 ml of methanol was dissolved 10.3 g (22 mmol) of the esterification product obtained in the foregoing process (3). To the solution was then added a solution prepared by dissolving 1.15 g (26 mmol) of sodium hydroxide (purity: 93%) in 20 ml of water. The reaction mixture was then allowed to undergo reaction at room temperature for 1 day. To the reaction solution was then added concentrated hydrochloric acid to adjust the pH value thereof to 3. The resulting precipitate was then withdrawn by filtration.

The precipitate was then recrystallized from a mixture of methanol and water to obtain 9.4 g (21 mmol) of the desired compound (yield: 95.9%).

(5) Synthesis of Compound I-43

Into 600 ml of water was dissolved 20 g (0.47 mol) of sodium hydroxide (purity: 93%). The solution was then cooled to a temperature of not higher than 10° C. To the solution was then added dropwise 13 ml (0.25 mol) of bromine. To the reaction solution thus prepared was then gradually added dropwise a solution prepared by dissolving 9.34 g (21 mmol) of the mercaptoacetic acid derivative obtained in the foregoing process (4) and 2.2 g (26 mmol) of sodium hydrogencarbonate into a mixture of 50 ml of 1,4-dioxane and 300 ml of water with stirring over a period of 1 hour while the temperature of the reaction system was kept at 5° C. or lower. After completion of the dropwise addition, the temperature of the reaction solution was gradually returned to room temperature with stirring. The reaction solution was then allowed to undergo reaction at the same temperature for 2 days. The resulting precipitate was withdrawn by filtration, freed of raw components through a column filled with ethyl acetate and hexane, and then recrystallized from a mixture of ethanol and acetonitrile to obtain 6.3 g (9.4 mmol) of Compound I-43 as the target compound (yield: 42.6%; melting point: 160–162° C.).

SYNTHESIS EXAMPLE

Synthesis of Compound I-45

(1) Synthesis of 3-mercapto-4-cyclohexyl-1,2,4-triazole

Into 300 ml of acetonitrile was suspended 30 g (0.5 mol) of formyl hydrazine. To the suspension was then added 70.6 g (0.5 mol) of cyclohexyl isothiocyanate. After completion of the dropwise addition, the temperature of the reaction solution was then gradually returned to room temperature. Thereafter, the reaction solution was heated to a temperature of 50° C. for 3 hours to undergo reaction, and then allowed to stand overnight. As a result, the reaction product was solidified. The reaction product was then withdrawn by suction filtration to remove the solvent.

Subsequently, the precipitate obtained above was added to a solution prepared by dissolving 64.5 g (1.5 mol) of sodium hydroxide (purity: 93%) into 600 ml of water. The reaction solution was then heated to a temperature of 100° C. for 1 hour to undergo reaction. The reaction solution was poured into ice water which was then treated with 130 ml of concentrated hydrochloric acid. The resulting precipitate was withdrawn by suction filtration, and then washed with water to obtain the desired triazole. The crude reaction product was then used as it was at the subsequent process.

(2) Synthesis of 3-carboxylmethylthio-4-cyclohexyl-1,2,4-triazole

Into 500 ml of ethanol were suspended the whole part (0.5 mol) of the triazole derivative obtained in the foregoing process (1) and 61.3 g (0.5 mol) of sodium chloroacetate. To the suspension was then added an aqueous solution prepared by dissolving 21.5 g (0.5 mol) of sodium hydroxide (purity: 93%) in 200 ml of water. The reaction mixture was allowed to undergo reaction at a temperature of 50° C. for 6 hours. The reaction solution was then allowed to cool to room temperature. The reaction solution was neutralized by dropwise addition of 43 ml of concentrated hydrochloric acid, and then allowed to stand overnight. The resulting precipitate was withdrawn by filtration, washed with water, and then dried to obtain 46.5 g (0.19 mol) of the desired mercaptoacetic acid derivative (yield: 38.5%).

(3) Synthesis of Compound I-45

Into 1.3 l of water was dissolved 105 g (2.44 mol) of sodium hydroxide (purity: 93%). The solution was then cooled to a temperature of not higher than 10° C. To the solution was then added dropwise 65 ml (1.26 mol) of bromine. To the reaction solution thus prepared was then gradually added dropwise a solution prepared by dissolving 36.2 g (0.15 mol) of the mercaptoacetic acid derivative obtained in the foregoing process (2) and 12.6 g (0.15 mol) of sodium hydrogencarbonate into 250 ml of water with stirring over a period of 3 hours while the temperature of the reaction system was kept at 5° C. or lower. After completion of the dropwise addition, the temperature of the reaction solution was gradually returned to room temperature with stirring. The reaction solution was then allowed to stand at the same temperature overnight. The resulting precipitate was withdrawn by filtration, thoroughly washed with water and dried, and then recrystallized from a mixture of ethanol and acetonitrile to obtain 33.8 g (0.073 mol) of Compound I-45 as the target compound (yield: 49.3%; melting point: 196–197° C. (decomposition)).

SYNTHESIS EXAMPLE

Synthesis of Compound I-46

(1) Synthesis of 3-mercapto-4-tert-butyl-1,2,4-triazole

Into a mixture of 100 ml of acetonitrile and 200 ml of THF (tetrahydrofuran) was suspended 10.5 g (174 mmol) of formyl hydrazine. To the suspension was then added dropwise 20 g (174 mmol) of t-butyl isothiocyanate. After completion of the dropwise addition, the reaction solution was allowed to stand for 5 days. To the reaction solution were then added 2.5 l of water and 150 g of sodium chloride. The resulting precipitate was then withdrawn by filtration.

Subsequently, the precipitate obtained above was added to a solution prepared by dissolving 21.5 g (0.5 mol) of sodium hydroxide (purity: 93%) into 200 ml of water. The reaction solution was then heated to a temperature of 100° C. for 1 hour to undergo reaction. The reaction solution was allowed to cool to room temperature, and then treated with 130 ml of concentrated hydrochloric acid. The resulting precipitate was withdrawn by suction filtration, washed with water, and then dried to obtain 27.1 g (172 mmol) of the desired triazole (yield: 98.9%).

(2) Synthesis of 3-carboxylmethylthio-4-tert-butyl-1,2,4-triazole

Into 400 ml of ethanol were suspended 20.4 g (0.13 mol) of the triazole derivative obtained in the foregoing process (1) and 19.5 g (0.156 mol) of sodium chloroacetate. To the suspension was then added an aqueous solution prepared by dissolving 6.7 g (0.156 mol) of sodium hydroxide (purity: 93%) in 200 ml of water. The reaction mixture was allowed to undergo reaction at a temperature of 50° C. for 6 hours. The reaction solution was then allowed to cool to room temperature. The reaction solution was neutralized by dropwise addition of 13.4 ml of concentrated hydrochloric acid, and then allowed to stand overnight. The reaction solution was subjected to evaporation by an evaporator to remove the solvent to dryness. To the reaction product thus dried was then added 200 ml of ethanol. The solution was then heated under reflux. The insoluble matters were then removed by filtration. The filtrate was concentrated, and then recrystallized to obtain 27 g (0.125 mol) of the desired mercaptoacetic acid derivative (yield: 96.4%).

(3) Synthesis of Compound I-46

Into 500 ml of water was dissolved 70 g (1.63 mol) of sodium hydroxide (purity: 93%). The solution was then cooled to a temperature of not higher than 10° C. To the solution was then added dropwise 43 ml (0.84 mol) of bromine. To the reaction solution thus prepared was then gradually added dropwise a solution prepared by dissolving 21.5 g (0.1 mol) of the mercaptoacetic acid derivative obtained in the foregoing process (2) and 10 g (0.12 mol) of sodium hydrogencarbonate into 100 ml of water with stirring over a period of 3 hours while the temperature of the reaction system was kept at 5° C. or lower. After completion of the dropwise addition, the temperature of the reaction solution was gradually returned to room temperature with stirring. The reaction solution was then allowed to stand at the same temperature overnight. The resulting precipitate was withdrawn by filtration, and then thoroughly washed with water and dried. The resulting powder was heated and dissolved in ethanol, and then cooled to undergo recrystallization. Thus, 13.8 g (0.036 mol) of Compound I-46 was obtained as the target compound (yield: 36%; melting point: 250–252° C. (decomposition)).

SYNTHESIS EXAMPLE

Synthesis of Compound I-44

(1) Synthesis of 3-mercapto-4-phenyl-5-1'-ethylpentyl-1,2,4-triazole

Into 250 ml of tetrahydrofuran was suspended 25 g (0.15 mol) of 4-phenyl-3-thiosemicarbazide. To the suspension was then added 21 ml (0.15 mol) of triethylamine. The reaction mixture was then cooled with ice to 10° C. or lower where it was then kept. To the reaction mixture which had been cooled with ice was then added dropwise 25 g (0.153 mol) of 2-ethylhexanic acid chloride while the temperature of the reaction system was kept at 10° C. or lower. After completion of the dropwise addition, the reaction solution was continuously stirred for 3 hours. The temperature of the reaction solution was returned to room temperature. The reaction solution was then allowed to stand at the same temperature overnight. To the reaction solution was added 2 l of water. The resulting precipitate was then withdrawn by filtration.

Subsequently, the precipitate obtained above was added to a solution prepared by dissolving 19.4 g (0.45 mol) of sodium hydroxide (purity: 93%) into 200 ml of water. The reaction solution was then heated to a temperature of 100° C. for 3 hours to undergo reaction. The reaction solution was allowed to cool to room temperature where it was then treated with 38.6 ml of concentrated hydrochloric acid. The resulting precipitate was withdrawn by suction filtration, and then washed with water to obtain the desired triazole. The reaction product was then used undried at the subsequent process.

(2) Synthesis of 3-carboxylmethylthio-4-phenyl-5-11-ethylpentyl-1,2,4-triazole

Into 400 ml of ethanol were suspended the whole part (0.5 mol) of the triazole derivative obtained in the foregoing process (1) and 20 g (0.16 mol) of sodium chloroacetate. To the suspension was then added an aqueous solution prepared by dissolving 7 g (0.16 mol) of sodium hydroxide (purity: 93%) in 200 ml of water. The reaction mixture was allowed to undergo reaction at a temperature of 50° C. for 2 hours. The reaction solution was then allowed to cool to room temperature. The reaction solution was then neutralized by dropwise addition of 13.7 ml of concentrated hydrochloric acid. The resulting precipitate was withdrawn by filtration, washed with water, and then dried. The precipitate thus obtained was then recrystallized from ethyl acetate to obtain 36 g (0.108 mol) of the desired mercaptoacetic acid derivative (yield: 72%).

(3) Synthesis of Compound I-44

Into 1.8 l of water was dissolved 70 g (1.6 mol) of sodium hydroxide (purity: 93%). The solution was then cooled to a temperature of not higher than 10° C. To the solution was then added dropwise 44 ml (0.854 mol) of bromine. To the reaction solution thus prepared was then gradually added dropwise a solution prepared by dissolving 26.6 g (0.08 mol) of the mercaptoacetic acid derivative obtained in the foregoing process (2) and 9.2 g (0.11 mol) of sodium hydrogencarbonate into a mixture of 300 ml of 1,4-dioxane and 500 ml of water with stirring over a period of 3 hours while the temperature of the reaction system was kept at 5° C. or lower. After completion of the dropwise addition, the temperature of the reaction solution was gradually raised to 50° C. with stirring. The reaction solution was further stirred at the same temperature for about 18 hours until the foaming of the reaction solution was suspended, and then allowed to stand at room temperature overnight. The resulting precipitate was withdrawn by filtration, thoroughly washed with water and dried, and then recrystallized from ethanol to obtain 23.2 g (0.042 mol) of Compound I-44 as the target compound (yield: 52%; melting point: 174.5–175.5° C.).

SYNTHESIS EXAMPLE

Synthesis of Compound I-47

(1) Synthesis of 3-mercapto-4-adamantly-1,2,4-triazole

Into 200 ml of THF was suspended 12 g (0.2 mol) of formyl hydrazine. To the suspension was then added dropwise a THF solution of 38.7 g (0.2 mol) of 1-adamantyl isothiocyanate. After completion of the dropwise addition, the reaction solution was heated to a temperature of 50° C. for 3 hours to undergo reaction, and then allowed to stand at room temperature overnight. The reaction solution was concentrated to dryness by means of an evaporator. The resulting solid matter was then used as it was at the subsequent process.

Subsequently, the precipitate obtained above was added to a solution prepared by dissolving 25.8 g (0.6 mol) of sodium hydroxide (purity: 93%) into 250 ml of water. The reaction solution was then heated to a temperature of 100° C. for 3 hours to undergo reaction. The reaction solution was allowed to cool to room temperature, and then treated with 55 ml of concentrated hydrochloric acid. The resulting precipitate was withdrawn by suction filtration, and then washed with water to obtain the desired triazole. The reaction product was used undried at the subsequent process.

(2) Synthesis of 3-carboxylmethylthio-4-adamantyl-1,2,4-triazole

Into 500 ml of ethanol were suspended the whole part of the triazole derivative obtained in the foregoing process (1) and 36.8 g (0.3 mol) of sodium chloroacetate. To the suspension was then added an aqueous solution prepared by dissolving 12.9 g (0.3 mol) of sodium hydroxide (purity: 93%) into 200 ml of water. The reaction mixture was allowed to undergo reaction at a temperature of 50° C. for 8 hours. The reaction solution was then allowed to cool to room temperature. The insoluble matters were removed by filtration. The filtrate was then neutralized by dropwise addition of 25.7 ml of concentrated hydrochloric acid. The resulting precipitate was then withdrawn by filtration. The precipitate was then recrystallized from a mixture of ethanol and ethyl acetate to obtain 46 g (0.157 mol) of the desired mercaptoacetic acid derivative (yield: 78.4%).

(3) Synthesis of Compound I-47

Into 2.3 l of water was dissolved 107.5 g (2.5 mol) of sodium hydroxide (purity: 93%). The solution was then cooled to a temperature of not higher than 10° C. To the solution was then added dropwise 67.5 ml (1.3 mol) of bromine. To the reaction solution thus prepared was then gradually added dropwise a solution prepared by dissolving 37 g (0.157 mol) of the mercaptoacetic acid derivative obtained in the foregoing process (2) and 13.2 g (0.157 mol) of sodium hydrogencarbonate into a mixture of 1,000 ml of water and 300 ml of dioxane with stirring over a period of 3 hours while the temperature of the reaction system was kept at 10° C. or lower. After completion of the dropwise addition, the temperature of the reaction solution was gradually raised to 30° C. with stirring. The reaction solution was then allowed to undergo reaction at the same temperature for 4 hours. The reaction solution was then allowed to stand overnight. The resulting precipitate was withdrawn by filtration, thoroughly washed with water and dried, and then recrystallized from a mixture of ethanol and acetonitrile to obtain 30 g (0.058 mol) of Compound I-47 as the target compound (yield: 36.9%; melting point: 182–183° C.)

SYNTHESIS EXAMPLE

Synthesis of Compound I-48

(1) Synthesis of 4-butyl-5-heptyl-3-mercapto-1,2,4-triazole

Into 400 ml of THF was suspended 39.6 g (0.25 mol) of octanoyl hydrazine. The suspension was then cooled with ice. To the suspension was then added dropwise 28.8 g (0.25 mol) of butyl isothiocyanate. After completion of the dropwise addition, the reaction solution was heated to a temperature of 50° C. for 4 hours to undergo reaction, and then allowed to stand overnight. The reaction solution was concentrated to dryness by means of an evaporator. The resulting solid matter was then used as it was at the subsequent process.

Subsequently, the whole part of the precipitate obtained above was added to a solution prepared by dissolving 32.3 g (0.75 mol) of sodium hydroxide (purity: 93%) into 300 ml of water. The reaction solution was then heated to a temperature of 100° C. for 1 hour to undergo reaction. The reaction solution was poured into ice water which was then treated with 64.4 ml of concentrated hydrochloric acid. The resulting precipitate was withdrawn by suction filtration, and then washed with water to obtain the desired triazole. The reaction product was used undried at the subsequent process.

(2) Synthesis of 3-carboxylmethylthio-4-butyl-5-heptyl-1,2,4-triazole

Into 400 ml of ethanol were suspended the whole part of the triazole derivative obtained in the foregoing process (1) and 30.6 g (0.25 mol) of sodium chloroacetate. To the suspension was then added an aqueous solution prepared by dissolving 10.7 g (0.25 mol) of sodium hydroxide (purity: 93%) into 100 ml of water. The reaction mixture was allowed to undergo reaction at a temperature of 50° C. for 7 hours. The reaction solution was then allowed to cool to room temperature. The reaction solution was neutralized by dropwise addition of 21.5 ml of concentrated hydrochloric acid, and then allowed to stand overnight. The resulting precipitate was then withdrawn by filtration, washed with water, and then dried to obtain 53.3 g (0.17 mol) of the desired mercaptoacetic acid derivative (yield: 68%).

(3) Synthesis of Compound I-48

Into 1.5 l of water was dissolved 68.8 g (1.6 mol) of sodium hydroxide (purity: 93%). The solution was then cooled to a temperature of not higher than 10° C. To the solution was then added dropwise 43 ml (0.84 mol) of bromine. To the reaction solution thus prepared was then gradually added dropwise a solution prepared by dissolving 31.3 g (0.1 mol) of the mercaptoacetic acid derivative obtained in the foregoing process (2) and 9.2 g (0.11 mol) of sodium hydrogencarbonate into a mixture of 200 ml of 1,4-dioxane and 500 ml of water with stirring over a period of 1 hour while the temperature of the reaction system was kept at 5° C. or lower. After completion of the dropwise addition, the temperature of the reaction solution was gradually raised to 50° C. with stirring. The reaction solution was further stirred for about 18 hours until the foaming thereof was suspended, and then allowed to stand at room temperature overnight. The resulting precipitate was withdrawn by filtration, thoroughly washed with water and dried, and then recrystallized from a mixture of ethanol and acetonitrile to obtain 33.3 g (0.062 mol) of Compound I-48 as the target compound (yield: 61.9%; melting point: 151–152° C.)

SYNTHESIS EXAMPLE

Synthesis of Compound I-49

(1) Synthesis of 4-methyl-5-pentadecyl-3-mercapto-1,2,4-triazole

Into 500 ml of THF was suspended 26.3 g (0.25 mol) of 4-methyl-3-thiosemicarbazide. To the suspension was then added 41.9 ml (0.30 mol) of triethylamine. The mixture was then cooled with ice to 10° C. or lower where it was kept. To the mixture which had been cooled with ice was then added dropwise 82.5 g (0.30 mol) of palmitic acid chloride while the temperature of the reaction system was kept at 10° C. or lower. After completion of the dropwise addition, the reaction solution was heated to a temperature of 50° C. for 4 hours to undergo reaction, and then allowed to stand overnight. To the reaction solution was then added 2 l of water. The resulting precipitate was withdrawn by filtration, and then washed with water. The resulting precipitate was then used as it was at the subsequent process.

Subsequently, the whole part of the precipitate obtained above was added to a solution prepared by dissolving 32.3 g (0.75 mol) of sodium hydroxide (purity: 93%) into 700 ml of water. The reaction solution was then heated to a temperature of 100° C. for 1 hour to undergo reaction. The reaction solution was poured into ice water which was then treated with 64.4 ml of concentrated hydrochloric acid. The resulting precipitate was withdrawn by suction filtration, and then washed with water to obtain the desired triazole. The reaction product was used undried at the subsequent process.

(2) Synthesis of 3-carboxylmethylthio-4-methyl-5-pentadecyl-1,2,4-triazole

Into 600 ml of ethanol were suspended the whole part of the triazole derivative obtained in the foregoing process (1) and 30.6 g (0.25 mol) of sodium chloroacetate. To the suspension was then added an aqueous solution prepared by dissolving 10.7 g (0.25 mol) of sodium hydroxide (purity: 93%) into 200 ml of water. The reaction mixture was allowed to undergo reaction at a temperature of 50° C. for 12 hours. The reaction solution was then allowed to cool to room temperature. The reaction solution was neutralized by dropwise addition of 21.5 ml of concentrated hydrochloric acid, and then allowed to stand overnight. The resulting precipitate was then withdrawn by filtration, washed with water, and then dried to obtain 60.4 g (0.158 mol) of the desired mercaptoacetic acid derivative (yield: 63%).

(3) Synthesis of Compound I-49

Into 1.5 l of water was dissolved 68.8 g (1.6 mol) of sodium hydroxide (purity: 93%). The solution was then cooled to a temperature of not higher than 10° C. To the solution was then added dropwise 43 ml (0.84 mol) of bromine. To the reaction solution thus prepared was then gradually added dropwise a solution prepared by dissolving 40 g (0.1 mol) of the mercaptoacetic acid derivative obtained in the foregoing process (2) and 10 g (0.12 mol) of sodium hydrogencarbonate into a mixture of 200 ml of 1,4-dioxane and 500 ml of water with stirring over a period of 1 hour while the temperature of the reaction system was kept at 5° C. or lower. After completion of the dropwise addition, the temperature of the reaction solution was gradually raised to 50° C. with stirring. The reaction solution was further stirred for about 18 hours until the foaming thereof was suspended, and then allowed to stand at room temperature overnight. The resulting precipitate was withdrawn by filtration, thoroughly washed with water and dried, and then recrystallized from a mixture of ethanol and acetonitrile to obtain 28.5 g (0.047 mol) of Compound I-49 as the target compound (yield: 46.9%; melting point: 171–173° C.)

SYNTHESIS EXAMPLE

Synthesis of Compound I-51

(1) Synthesis of 3-mercapto-4-butyl-1,2,4-triazole

Into 200 ml of THF was suspended 30 g (0.5 mol) of formyl hydrazine. To the suspension was then added 57.6 g (0.5 mol) of n-butyl isothiocyanate. After completion of the dropwise addition, the reaction solution was heated to a temperature of 50° C. for 3 hours to undergo reaction, and then allowed to stand overnight. As a result, the reaction product was solidified. The reaction product was then filtered with suction to remove the solvent therefrom.

Subsequently, the precipitate obtained above was added to a solution prepared by dissolving 64.5 g (1.5 mol) of sodium hydroxide (purity: 93%) into 600 ml of water. The reaction solution was then heated to a temperature of 100° C. for 1 hour to undergo reaction. The reaction solution was poured into ice water which was then treated with 140 ml of concentrated hydrochloric acid. The resulting precipitate was withdrawn by suction filtration, washed with water, and then dried to obtain 62.6 g (0.398 mol) of the desired triazole (yield: 79.6%).

(2) Synthesis of 3-carboxylmethylthio-4-cyclohexyl-1,2,4-triazole

Into 500 ml of ethanol were suspended 60 g (0.38 mol) of the triazole derivative obtained in the foregoing process (1) and 55.9 g (0.456 mol) of sodium chloroacetate. To the suspension was then added an aqueous solution prepared by dissolving 19.6 g (0.456 mol) of sodium hydroxide (purity: 93%) into 200 ml of water. The reaction mixture was allowed to undergo reaction at a temperature of 50° C. for 6 hours. The reaction solution was then allowed to cool to room temperature. The reaction solution was neutralized by dropwise addition of 31 ml of concentrated hydrochloric acid, and then extracted with a mixture of ethyl acetate and saturated brine. The resulting organic phase was then dried and concentrated. The solid matter thus obtained was then recrystallized from a mixture of ethyl acetate and hexane to obtain 45.8 g (0.21 mol) of the desired mercaptoacetic acid derivative (yield: 56%).

(3) Synthesis of Compound I-51

Into 800 ml of water was dissolved 107.5 g (2.5 mol) of sodium hydroxide (purity: 93%). The solution was then cooled to a temperature of not higher than 10° C. To the solution was then added dropwise 67.5 ml (1.3 mol) of bromine. To the reaction solution thus prepared was then gradually added dropwise a solution prepared by dissolving 32.3 g (0.15 mol) of the mercaptoacetic acid derivative obtained in the foregoing process (2) and 13 g (0.15 mol) of sodium hydrogencarbonate into 200 ml of water with stirring over a period of 2 hours while the temperature of the reaction system was kept at 5° C. or lower. After completion of the dropwise addition, the temperature of the reaction solution was gradually raised to room temperature with stirring. The reaction solution was then allowed to stand overnight. The resulting precipitate was withdrawn by filtration, thoroughly washed with water and dried, and then recrystallized from a mixture of ethanol and acetonitrile to obtain 29.5 g (0.067 mol) of Compound I-51 as the target compound (yield: 44.7%; melting point: 197–198° C.)

SYNTHESIS EXAMPLE

Synthesis of Compound I-52

(1) Synthesis of 4-methyl-5-1'-ethylpentyl-3-mercapto-1,2,4-triazole

Into 700 ml of THF was suspended 46.5 g (0.44 mol) of 4-methyl-3-thiosemicarbazide. To the suspension was then added 70 ml (0.50 mol) of triethylamine. The reaction mixture was then cooled with ice to 10° C. or lower where it was kept. To the mixture which had been cooled with ice was then added dropwise 73.2 g (0.44 mol) of 2-ethylhexanic acid chloride while the temperature of the reaction system was kept at 10° C. or lower. After completion of the dropwise addition, the reaction solution was heated to a temperature of 50° C. for 3 hours to undergo reaction. To the reaction solution was then added 2 l of water. The resulting precipitate was withdrawn by filtration, and then washed with water. The resulting precipitate was then used as it was at the subsequent process.

Subsequently, the whole part of the precipitate obtained above was added to a solution prepared by dissolving 56.8 g (1.32 mol) of sodium hydroxide (purity: 93%) into 600 ml of water. The reaction solution was then heated to a temperature of 100° C. for 3 hours to undergo reaction. The reaction solution was poured into ice water which was then treated with 115 ml of concentrated hydrochloric acid. The resulting precipitate was withdrawn by suction filtration, and then washed with water to obtain the desired triazole. The reaction product was then used undried at the subsequent process.

(2) Synthesis of 3-carboxylmethylthio-4-methyl-5-1'-ethylpentyl-1,2,4-triazole

Into a mixture of 600 ml of ethanol and 400 ml of water were suspended the whole part of the triazole derivative obtained in the foregoing process (1) and 80.9 g (0.66 mol) of sodium chloroacetate. To the suspension was then added an aqueous solution prepared by dissolving 28.4 g (0.66 mol) of sodium hydroxide (purity: 93%) into 400 ml of water. The reaction mixture was allowed to undergo reaction at a temperature of 50° C. for 12 hours. The reaction solution was then allowed to cool to room temperature. The reaction solution was neutralized by dropwise addition of 57 ml of concentrated hydrochloric acid, and then allowed to stand overnight. The resulting precipitate was withdrawn by filtration, washed with water, and then dried to obtain 81.2 g (0.30 mol) of the desired mercaptoacetic acid derivative (yield: 68%).

(3) Synthesis of Compound I-52

Into 2 l of water was dissolved 70 g (1.63 mol) of sodium hydroxide (purity: 93%). The solution was then cooled to a temperature of not higher than 10° C. To the solution was then added dropwise 43 ml (0.84 mol) of bromine. To the reaction solution thus prepared was then gradually added dropwise a solution prepared by dissolving 27.1 g (0.1 mol) of the mercaptoacetic acid derivative obtained in the foregoing process (2) and 8.4 g (0.1 mol) of sodium hydrogencarbonate into a mixture of 200 ml of 1,4-dioxane and 700 ml of water with stirring over a period of 1 hour while the temperature of the reaction system was kept at 5° C. or lower. After completion of the dropwise addition, the temperature of the reaction solution was gradually returned to room temperature with stirring. The reaction solution was then allowed to stand overnight. The resulting precipitate was withdrawn by filtration, thoroughly washed with water and dried, and then recrystallized from ethanol to obtain 14.1 g (0.028 mol) of Compound I-52 as the target compound (yield: 28.4%; melting point: 140-141° C.)

SYNTHESIS EXAMPLE

Synthesis of Compound I-53

(1) Synthesis of 3-carboxylmethylthio-4,5-dimethyl-1,2,4-triazole

Into 250 ml of THF was suspended 50 g (0.67 mol) of acetyl hydrazine. To the suspension was then added 49.7 g (0.68 mol) of methyl isothiocyanate. After completion of the dropwise addition, the reaction solution was heated to a temperature of 50° C. for 2 hours to undergo reaction, and then allowed to stand overnight. As a result, the reaction product was solidified. The reaction product was then filtered with suction to remove the solvent therefrom.

Subsequently, the precipitate obtained above was added to a solution prepared by dissolving 86.5 g (2 mol) of sodium hydroxide (purity: 93%) into 800 ml of water. The reaction solution was then heated to a temperature of 100° C. for 1 hour to undergo reaction. The reaction solution was then cooled to a temperature of 50° C. To the reaction solution was then added 98.6 g (2 mol) of sodium chloroacetate. The reaction mixture was allowed to undergo reaction at the same temperature for 2 hours, and then allowed to stand overnight. To the reaction solution was then added concentrated hydrochloric acid to adjust the pH value thereof to 4. The reaction solution was then concentrated by means of an evaporator. The resulting precipitate was withdrawn by suction filtration, washed with water, and then dried to obtain 105.3 g (0.56 mol) of the desired mercaptoacetic acid derivative (yield: 84%).

(2) Synthesis of Compound I-53

Into 2 l of water was dissolved 315 g (7.32 mol) of sodium hydroxide (purity: 93%). The solution was then cooled to a temperature of not higher than 10° C. To the solution was then added dropwise 195 ml (3.78 mol) of bromine. To the reaction solution thus prepared was then gradually added dropwise a solution prepared by dissolving 84.2 g (0.45 mol) of the mercaptoacetic acid derivative obtained in the foregoing process (1) and 45 g (0.54 mol) of sodium hydrogencarbonate into 400 ml of water with stirring over a period of 2 hours while the temperature of the reaction system was kept at 5° C. or lower. After completion of the dropwise addition, the temperature of the reaction solution was gradually raised to room temperature with stirring. The reaction solution was then allowed to stand overnight. The resulting precipitate was withdrawn by filtration, thoroughly washed with water and dried, and then recrystallized from a mixture of ethanol and acetonitrile to obtain 69.2 g (0.168 mol) of Compound I-53 as the target compound (yield: 37.3%; melting point: 209–211° C.)

SYNTHESIS EXAMPLE

Synthesis of Compound I-54

(1) Synthesis of 3-carboxylmethylthio-4-methyl-5-isopropyl-1,2,4-triazole

Into a mixture of 250 ml of THF and 250 ml of acetonitrile was suspended 52.6 g (0.5 mol) of 4-methyl-3-thiosemicarbazide. To the suspension was then added 70 ml (0.50 mol) of triethylamine. The reaction mixture was cooled with ice to 10° C. or lower where it was then kept. To the mixture which had been cooled with ice was then added dropwise 58.6 g (0.55 mol) of isobutyric acid chloride. After completion of the dropwise addition, the reaction solution was heated to a temperature of 50° C. for 2 hours to undergo reaction. The reaction solution was then allowed to cool to room temperature. To the reaction solution was then added 300 ml of water. To the reaction solution was then added a solution prepared by dissolving 64.5 g (1.5 mol) of sodium hydroxide (purity: 93%) into 300 ml of water. The reaction solution was then heated to undergo reaction for 2 hours while acetonitrile and THF were being distilled off. The reaction solution was then cooled to 50° C. To the reaction solution was then added 73.6 g (0.6 mol) of sodium chloroacetate. The reaction solution was allowed to undergo reaction at the same temperature for 2 hours, and then allowed to stand overnight. To the reaction solution was then added concentrated hydrochloric acid to adjust the pH value thereof to 4. The reaction solution was then concentrated by means of an evaporator. The resulting precipitate was withdrawn by suction filtration, washed with water, and then dried to obtain 60.3 g (0.30 mol) of the desired mercaptoacetic acid derivative (yield: 59%).

(2) Synthesis of Compound I-54

Into 1.3 l of water was dissolved 210 g (4.88 mol) of sodium hydroxide (purity: 93%). The solution was then cooled to a temperature of not higher than 10° C. To the solution was then added dropwise 130 ml (2.52 mol) of bromine. To the reaction solution thus prepared was then gradually added dropwise a solution prepared by dissolving 61 g (0.3 mol) of the mercaptoacetic acid derivative obtained in the foregoing process (1) and 30.2 g (0.36 mol) of sodium hydrogencarbonate into 400 ml of water with stirring over a period of 2 hours while the temperature of the reaction system was kept at 5° C. or lower. After completion of the dropwise addition, the temperature of the reaction solution was gradually raised to room temperature with stirring. The reaction solution was then allowed to stand overnight. The resulting precipitate was withdrawn by filtration, thoroughly washed with water and dried, and then recrystallized from a mixture of ethanol and acetonitrile to obtain 74.2 g (0.169 mol) of Compound I-54 as the target compound (yield: 56.2%; melting point: 212–213° C.)

SYNTHESIS EXAMPLE

Synthesis of Compound I-55

(1) Synthesis of 2-nitro-N-octylaniline 157.6 g (1 mol) of 2-nitrochlorobenzene and 280 g (2.2 mol) of octylamine were mixed. The reaction mixture was heated to a temperature of 150° C. for 3 hours to undergo reaction, and then allowed to stand overnight. To the reaction solution was then added a mixture of ethyl acetate and saturated brine. The reaction solution was then subjected to separation. The organic phase thus extracted was dried and concentrated to obtain 235 g (0.93 mol) of the desired aniline derivative (yield: 93%).

(2) Synthesis of N-octyl-o-phenylenediamine

Into 450 ml of ethanol was dissolved 50.1 g (0.2 mol) of the nitroaniline derivative obtained in the foregoing process (1). The solution was then transferred into a 1 l autoclave. To the solution was then added 2 g of a 50% palladium-charcoal catalyst. Into the vessel was then charged hydrogen gas at a pressure of 50 kg/cm$^2$ with the vessel hermetically sealed. The reaction mixture was then stirred at room temperature under raised pressure for 3 hours. Thereafter, the pressure in the vessel was returned to atmospheric pressure. The air in the vessel was then replaced by nitrogen. The content of the vessel was then withdrawn. The reaction solution was then filtered through Celite to remove the catalyst therefrom. To the filtrate was then added an ethanol solution of 72 g (0.2 mol) of 1,5-naphthalenedisulfonic acid. The reaction solution was then concentrated to obtain 85.3 g (0.17 mol) of a 1:1 sulfonate of phenylenediamine as the target compound (yield: 83.9%).

(3) Synthesis of 2-mercapto-N-octylbenzimidazole

Into 500 ml of acetonitrile was suspended 50.9 g (0.1 mol) of the phenylenediamine derivative obtained in the foregoing process (2) in an atmosphere of nitrogen. The suspension was cooled with ice to 5° C. or lower where it was then kept. To the suspension was then added 55.8 ml (0.4 mol) of triethylamine. To the reaction mixture was then added dropwise 11.5 g (0.1 mol) of thiophosgene while the temperature of the reaction system was being controlled to lower than 10° C. After completion of the dropwise addition, the temperature of the reaction solution was gradually returned to room temperature. The reaction solution was then allowed to undergo at the same temperature for 2 hours. To the reaction solution was then added a mixture of ethyl acetate and water. The reaction solution was then subjected to separation. The organic phase thus extracted was dried, and then concentrated to obtain 29.4 g of a crude reaction product in the form of oil. The crude reaction product was then purified through a column filled with a ⅕ mixture of ethyl acetate and hexane to obtain 12.6 g (0.048 mol) of the desired benzimidazole (yield: 48%).

(4) Synthesis of 2-carboxylmethylthio-N-octylbenzimidazole

Into 100 ml of ethanol was dissolved 7.4 g (28 mmol) of the benzimidazole derivative obtained in the foregoing process (3) and 5.1 g (42 mmol) of sodium chloroacetate. To the suspension was then added a solution prepared by dissolving 1.8 g (42 mmol) of sodium hydroxide (purity: 93%) into 10 ml of water. The reaction mixture was heated to a temperature of 50° C. for 4 hours, and then allowed to stand overnight. The reaction solution was then neutralized with 3.6 ml of concentrated hydrochloric acid. The resulting precipitate was withdrawn by filtration, washed with water, and then dried to obtain 8.9 g (27.7 mmol) of the desired mercaptoacetic acid derivative (yield: 99%).

(5) Synthesis of Compound I-55

Into 450 ml of water was dissolved 17.2 g (0.4 mol) of sodium hydroxide (purity: 93%). The solution was then cooled to a temperature of not higher than 10° C. To the solution was then added dropwise 11 ml (0.213 mol) of bromine. To the reaction solution thus prepared was then gradually added dropwise a solution prepared by dissolving 8 g (25 mmol) of the mercaptoacetic acid derivative obtained in the foregoing process (4) and 2.5 g (30 mmol) of sodium hydrogencarbonate into a mixture of 50 ml of dioxane and 80 ml of water with stirring while the temperature of the reaction system was kept at 5° C. or lower. After completion of the dropwise addition, the temperature of the reaction solution was gradually raised to 50° C. with stirring. The reaction solution was allowed to undergo reaction at the same temperature for 18 hours, and then allowed to stand overnight. The resulting precipitate was withdrawn by filtration, thoroughly washed with water and dried, and then recrystallized from ethanol to obtain 9.8 g (18 mmol) of Compound I-55 as the target compound (yield: 72%; melting point: 108–109° C.).

SYNTHESIS EXAMPLE

Synthesis of Compound I-25

(1) Synthesis of 2-mercapto-N-phenylbenzimidazole

Into 500 ml of acetonitrile was suspended 40 g (0.217 mol) of N-phenylenediamine in an atmosphere of nitrogen. The suspension was cooled with ice to 5° C. or lower where it was then kept. To the suspension was then added 37 ml (0.477 mol) of pyridine. To the reaction mixture was then added dropwise 25 g (0.217 mol) of thiophosgene while the temperature of the reaction system was being controlled to lower than 10° C. After completion of the dropwise addition, the temperature of the reaction solution was gradually returned to room temperature. The reaction solution was then allowed to undergo at the same temperature for 2 hours. To the reaction solution was then added water. The resulting precipitate was withdrawn by filtration, washed with water, dried, and then recrystallized from methanol to obtain 30.9 g (0.137 mol) of benzimidazole as the target compound (yield: 63%).

(2) Synthesis of 2-carboxylmethylthio-N-phenylbenzimidazole

Into 300 ml of ethanol was dissolved 23 g (0.1 mmol) of the benzimidazole derivative obtained in the foregoing process (1) and 14.7 g (0.12 mol) of sodium chloroacetate. To the suspension was then added a solution prepared by dissolving 5.2 g (0.12 mol) of sodium hydroxide (purity: 93%) into 100 ml of water. The reaction mixture was heated to a temperature of 50° C. for 4 hours, and then allowed to stand overnight. The reaction solution was then neutralized with 10.3 ml of concentrated hydrochloric acid. To the reaction solution was then added a mixture of ethyl acetate and saturated brine. The reaction solution was then subjected to separation to extract an organic phase. To the resulting ethyl acetate solution was then added 10 g of activated carbon. The reaction mixture was heated under reflux for 20 minutes, and then filtered through Celite to remove the activated carbon. The filtrate was then cooled. The resulting precipitate was withdrawn by filtration to obtain 24.3 g (0.085 mol) of the desired mercaptoacetic acid derivative (yield: 85.6%).

(3) Synthesis of Compound I-25

Into 500 ml of water was dissolved 70 g (1.6 mol) of sodium hydroxide (purity: 93%). The solution was then cooled to a temperature of not higher than 10° C. To the solution was then added dropwise 44 ml (0.854 mol) of bromine. To the reaction solution thus prepared was then gradually added dropwise a solution prepared by dissolving 22.7 g (0.08 mol) of the mercaptoacetic acid derivative obtained in the foregoing process (2) and 9 g (0.11 mol) of sodium hydrogencarbonate into 500 ml of water with stirring while the temperature of the reaction system was kept at 5° C. or lower. After completion of the dropwise addition, the temperature of the reaction solution was gradually raised to 50° C. with stirring. The reaction solution was allowed to undergo reaction at the same temperature for 18 hours, and then allowed to stand overnight. The resulting precipitate was withdrawn by filtration, thoroughly washed with water and dried, and then recrystallized from a mixture of ethanol and acetonitrile to obtain 21.6 g (0.042 mol) of Compound I-25 as the target compound (yield: 53%; melting point: 193–196° C. (decomposition)).

SYNTHESIS EXAMPLE

Synthesis of Compound I-50

(1) Synthesis of 2-carboxylmethylthio-N-methyl-1,2,4-triazole

Into 400 ml of ethanol were dissolved 50.0 g (0.434 mol) of 3-mercapto-4-methyl-1,2,4-triazole and 79.8 g (0.64 mol) of sodium chloroacetate (purity: 95%). To the suspension was then added an aqueous solution prepared by dissolving 28 g (0.651 mol) of sodium hydroxide (purity: 93%) into 300 ml of water. The reaction mixture was allowed to undergo reaction at a temperature of 50° C. for 3 hours, allowed to cool to room temperature, adjusted with concentrated hydrochloric acid to pH 2, and then allowed to stand overnight. The resulting precipitate was withdrawn by filtration, washed with water, and then dried to obtain 60.9 g (0.352 mol) of the desired mercaptoacetic acid derivative (yield: 81%).

(3) Synthesis of Compound I-50

Into 2 l of water was dissolved 336 g (7.81 mol) of sodium hydroxide (purity: 93%). The solution was then cooled to a temperature of not higher than 10° C. To the solution was then added dropwise 201 ml (3.9 mol) of bromine. To the reaction solution thus prepared was then gradually added dropwise a solution prepared by dissolving 69.2 g (0.4 mol) of the mercaptoacetic acid derivative obtained in the foregoing process (2) and 109 g (1.3 mol) of sodium hydrogencarbonate into 500 ml of water with stirring over a period of 2 hours while the temperature of the reaction system was kept at 5° C. or lower. After completion of the dropwise addition, the temperature of the reaction solution was gradually raised to room temperature with stirring. The reaction solution was then allowed to stand overnight. The resulting precipitate was withdrawn by filtration, thoroughly washed with water and dried, and then recrystallized from a mixture of ethanol and acetonitrile to obtain 60.9 g (0.153 mol) of Compound I-50 as the target compound (yield: 38%; melting point: 184–185° C. (decomposition)).

The compounds represented by formula (I) of the present invention may be incorporated into either a photosensitive layer or a nonphotosensitive layer, but are preferably incorporated into a photosensitive layer.

Although the incorporation amount of the compounds represented by formula (I) of the present invention varies depending on intended purposes, it may be from $10^{-4}$ mol to 1 mol/mol-Ag, preferably from $10^{-3}$ mol to 0.3 mol/mol-Ag. Any of the compounds is preferably added as a solution in an organic solvent.

The photothermographic material of the present invention is preferably of the monosheet type (a type in which all materials provided for forming images are incorporated in the image sheet to be viewed), because this type of photosensitive materials are harmless or less harmful to the earth.

Further, the photothermographic material is preferably a photosensitive material for exposure with an infrared laser, which has a wavelength of desirably 750 nm or longer, preferably 800 nm or longer. In order for the photosensitive material to be suitable for use with a laser having such a wavelength region, the photosensitive material should have been spectrally sensitized so as to be sensitive in that wavelength region, i.e., infrared region. Known infrared sensitizing dyes may be used.

In the photothermographic material of the present invention, a photographic image is formed through heat development. As stated hereinabove, such photothermographic materials are disclosed, e.g., in U.S. Pat. Nos. 3,152,904 and 3,457,075 and in D. Morgan and B. Shely "Thermally Processed Silver Systems" (Imaging Processes and Materials, Neblette 8th ed., edited by Sturge, V. Walworth and A. Shepp, p. 2, 1969).

The photothermographic material of the present invention is not particularly limited as long as it forms a photographic image through heat development. However, the photothermographic material preferably contains a reducible silver salt (e.g., an organosilver salt), a catalytically effective amount of a photocatalyst (e.g., a photosensitive silver halide and/or an ingredient forming a photosensitive silver halide), and a reducing agent, which all are usually dispersed in an (organic) binder matrix. It preferably further contains a tone regulator for regulating the color tone of silver. The photothermographic material of the present invention, which is stable at ordinary temperature, gives an image upon heating to a high temperature (e.g., 80° C. or higher) after exposure. Namely, the reducible silver source (which functions as an oxidizing agent) undergoes an oxidation-reduction reaction with the reducing agent upon heating to yield silver. This oxidation-reduction reaction is accelerated by the catalytic action of the latent image formed by exposure. The silver yielded by the reaction of the organosilver salt in the exposed areas provides a black image, which makes a contrast with the unexposed areas.

The photothermographic material of the present invention has at least one photosensitive layer on a support. Although only a photosensitive layer may be formed on a support, at least one nonphotosensitive layer is preferably formed on the photosensitive layer.

For the purpose of regulating the quantity or wavelength distribution of light passing through the photosensitive layer, a filter layer may be formed on the side opposite to or the same as the photosensitive layer. Alternatively, a dye or a pigment may be incorporated into the photosensitive layer.

The photosensitive layer may be composed of two or more layers. It may comprise a combination of high-sensitivity layer/low-sensitivity layer or a combination of low-sensitivity layer/high-sensitivity layer for the purpose of regulating gradation. Various additives may be added to any of the photosensitive layer, the nonphotosensitive layer, and other layers.

Examples of supports usable in the photothermographic material of the present invention include materials such as paper, polyethylene-coated paper, polypropylene-coated paper, parchment, and fabrics; sheets or thin films of metals such as aluminum, copper, magnesium, and zinc; uncoated glasses and glasses coated with a metal such as a chromium alloy, steel, silver, gold, or platinum; and synthetic polymeric materials such as poly(alkyl methacrylate)s (e.g., poly(methyl methacrylate)), polyesters (e.g., poly(ethylene terephthalate)), poly(vinyl acetal)s, polyamides (e.g., nylon), and cellulose esters (e.g., cellulose nitrate, cellulose acetate, cellulose acetate propionate, and cellulose acetate butyrate).

Additives such as, e.g., a surfactant, antioxidant, stabilizer, plasticizer, ultraviolet absorber, and coating aid may be used for the photothermographic material of the present invention.

Each binder layer (e.g., a synthetic polymer) may form a self-supporting film together with chemicals contained in the photothermographic material of the present invention.

The support may be optionally coated with a known auxiliary agent, examples of which include copolymers and terpolymers of vinylidene chloride, acrylic monomers (e.g., acrylonitrile and methyl acrylate), and unsaturated dicarboxylic acids (e.g., itaconic acid), carboxymethyl cellulose, poly(acrylamide), and similar polymeric materials.

Binders suitable for use in the present invention are transparent or translucent and are generally colorless. Examples thereof include natural polymers, synthetic resins homopolymers and copolymers) and other film-forming media. Specific examples thereof include gelatin, gum arabic, poly(vinyl alcohol), hydroxyethyl cellulose, cellulose acetate, cellulose acetate butyrate, poly (vinylpyrrolidone), casein, starch, poly(acrylic acid), poly (methyl methacrylate), poly(vinyl chloride), poly (methacrylic acid), copoly(styrene-maleic anhydride), copoly(styrene-acrylonitrile), copoly(styrene-butadiene), poly(vinyl acetal)s (e.g., poly(vinyl formal) and poly(vinyl butyral)), polyesters, polyurethanes, phenoxy resins, poly (vinylidene chloride), polyepoxides, polycarbonates, poly (vinyl acetate)s, cellulose esters, and polyamides. Binders may be applied as a solution in water or an organic solvent or as an emulsion to form a coating film.

Addition of a tone regulator is highly desirable. Examples of tone regulators suitable for use in the present invention are disclosed in Research Disclosure No. 17,029, and include the following: imides (e.g., phthalimide); cyclic imides, pyrazolin-5-ones, and quinazolines (e.g., succinimide, 3-phenyl-2-pyrazolin-5-one, 1-phenylurazole, quinazoline, and 2,4-thiazolinedione); naphthalimides (e.g., N-hydroxy-1,8-naphthalimide); cobalt complexes (e.g., hexamine trifluoroacetate of cobalt), mercaptans (e.g., 3-mercapto-1,2,4-triazole); N-(aminomethyl) aryldicarboximides (e.g., N-(dimethylaminomethyl) phthalimide; combinations of a blocked pyrazole, an isothiuronium derivative, and any of some kinds of photobleaching agents (e.g., a combination of N,N'-hexamethylene(1-carbamoyl-3,5-dimethylpyrazole), 1,8-(3,6-dioxaoctane)bis(isothiuronium trifluoroacetate), and 2-(tribromomethylsulfonyl)benzothiazole); merocyanine dyes (e.g., 3-ethyl-5-((3-ethyl-2-benzothiazolinylidene-1-methylethylidene)-2-thio-2,4-oxazolidinedione); phthalazinone (phthalazone), phthalazinone derivatives, and metal salts of these derivatives (e.g., 4-(1-naphthyl)phthalazinone, 6-chlorophthalazinone, 5,7-dimethyloxyphthalazinone, and 2,3-dihydro-1,4-phthalazinone); phthalazine; combinations of phthalazinone and a sulfinic acid derivative (e.g., a combination of 6-chlorophthalazinone and sodium benzenesulfinate and a combination of 8-methylphthalazinone and sodium p-toluenesulfinate); combinations of phthalazine and phthalic acid; combinations of phthalazine (including a phthalazine adduct) with at least one compound selected from maleic acid, phthalic acid, 2,3-naphthalenedicarboxylic acid, o-phenylene acid derivatives, and anhydrides thereof (e.g., phthalic acid, 4-methylphthalic acid, 4-nitrophthalic acid, and tetrachlorophthalic anhydride); quinazolidinediones, benzoxazine, and naphthoxazine derivatives; benzoxazine-2,4 -diones (e.g., 1,3-benzoxazine-2,4-dione); pyrimidines and asymmetric triazines (e.g., 2,4-dihydroxypyrimidine); and tetrazapentalene derivatives (e.g., 3,6-dimercapto-1,4-diphenyl-1H,4H-2,3a,5,6a-tetrazapentalene).

Desirable tone regulators are the following compounds.

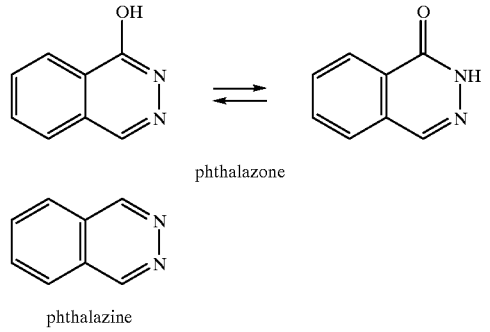

Preferred of these is phthalazine.

Such a tone regulator may be contained in an amount of desirably from 2 to 5,000 mg, preferably from 10 to 3,000 mg, per $m^2$ of the photosensitive material.

Although the reducing agent may contain a so-called photographic developing agent, e.g., Phenidone, hydroquinone or a derivative thereof, or catechol, it preferably comprises a hindered phenol.

Examples of reducing agents suitable for use in the present invention are shown in U.S. Pat. Nos. 3,770,448, 3,773,512, and 3,593,863 and Research Disclosure Nos. 17,029 and 29,963. Specifically, the examples include the following: aminohydroxycycloalkenone compounds (e.g., 2-hydroxypiperidino-2-cyclohexenone); aminoreductone esters as developing agent precursors (e.g., piperidinohexose reductone monoacetate); N-hydroxyurea derivatives (e.g., N-p-methylphenyl-N-hydroxyurea); hydrazones of either aldehydes or ketones (e.g., anthracenealdehydephenylhydrazone); phosphoramidophenols; phosphoramidoanilines; polyhydroxybenzenes (e.g., hydroquinone, t-butylhydroquinone, isopropylhydroquinone, and 2,5-dihydroxyphenyl methyl sulfone); sulfhydroxamic acids (e.g., benzenesulfhydroxamic acid); sulfonamidoanilines (e.g., 4-(N-methanesulfonamido)aniline); 2-tetrazolylthiohydroquinones (e.g., 2-methyl-5-(1-phenyl-5-tetrazolylthio)hydroquinone); tetrahydroquinoxalines (e.g., 1,2,3,4-tetrahydroquinoxaline); amidooxines; azines (e.g., a combination of an aliphatic carboxylic acid aryl hydrazide and ascorbic acid); combinations of a polyhydroxybenzene and hydroxylamine, reductones, and/or hydrazine; hydroxamic acids; combinations of an azine and a sulfonamidophenol; α-cyanophenylacetic acid derivatives; combinations of bis-o-naphthol and a 1,3-dihydroxybenzene derivative; 5-pyrazolones; sulfonamidophenol reducing agents; 2-phenylindane-1,3-diones; cumarone; 1,4-dihydropyridines (e.g., 2,6-dimethoxy-3,5-dicarboethoxy-1,4-dihydropyridine); bisphenols (e.g., bis(2-hydroxy-3-t-butyl-5-methylphenyl)methane, 2,2-bis(4-hydroxy-3-methylphenyl)propane, and 4,4-ethylidenebis(2-t-butyl-6-methyl)phenol); and ultraviolet-sensitive ascorbic acid derivatives and 3-pyrazolidones.

Preferred reducing agents are hindered phenols represented by formula (A):

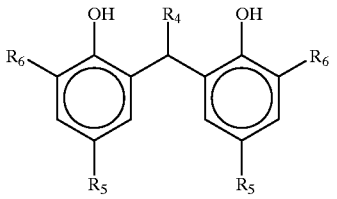

wherein $R_4$ represents a hydrogen atom or an alkyl group having 1 to 10 carbon atoms (e.g., —$C_4H_9$ or 2,4,4-trimethylpentyl), and $R_5$ and $R_6$ each represents an alkyl group having 1 to 5 carbon atoms (e.g., methyl, ethyl, or t-butyl).

The reducing agent is contained in an amount of desirably from 1 to 5,000 mg, preferably from 10 to 1,000 mg, per $m^2$ of the photosensitive material.

Any photosensitive silver halide (e.g., silver bromide, silver iodide, silver chloride, silver chlorobromide, silver iodobromide, or silver chloroiodobromide) is useful as the photocatalyst used in a catalytically effective amount. However, the photocatalyst preferably contains iodine ions. Any method can be used for incorporating such a silver halide into an image-forming layer, as long as the silver halide incorporated is disposed close to the reducible silver source. In general, the amount of a silver halide incorporated is preferably from 0.75 to 30% by weight based on the amount of the reducible silver source. A silver halide may be prepared from a silver soap through reaction thereof with halogen ions. Alternatively, a silver halide which has been previously prepared may be added during the generation of a soap. A combination of both is also usable. The latter method is preferred.

The reducible silver source may be any material containing a reducible silver ion source. Preferred are silver salts of organic and heteroorganic acids, in particular long-chain aliphatic carboxylic acids (having 10 to 30, preferably 15 to 25 carbon atoms). Also useful are organic or inorganic silver complexes in which the ligands have an overall stability constant for silver ions of from 4.0 to 10.0. Examples of silver salts suitable for use in the present invention are shown in Research Disclosure Nos. 17,029 and 29,963. Specifically, the examples include the following: salts of organic acids (e.g., gallic acid, oxalic acid, behenic acid, stearic acid, palmitic acid, and lauric acid); silver salts of carboxyalkylthioureas (e.g., 1-(3-carboxypropyl)thiourea and 1-(3-carboxypropyl)-3,3-dimethylthiourea); silver complexes of products of polymerization reactions of aldehydes and hydroxylated aromatic carboxylic acids (e.g., aldehydes such as formaldehyde, acetaldehyde, and butyraldehyde and hydroxylated acids such as salicylic acid, benzoic acid, 3,5-dihydroxybenzoic acid, and 5,5-thiodisalicylic acid); silver salts or complexes of thioenes (e.g., 3-(2-carboxyethyl)-4-hydroxymethyl-4-thiazoline-2-thioene and 3-carboxymethyl-4-thiazoline-2-thioene); silver complexes or salts of nitrogenous acids selected from imidazole, pyrazole, urazole, thiazole, 1H-terazole, 3-amino-5-benzylthio-1,2,4-triazole, and benzotriazole; silver salts of saccharin, 5-chlorosalicylaldoxime, and the like; and silver salts of mercaptides. Preferred silver sources are silver stearate and silver behenate, in particular silver behenate. The amount of the reducible silver source is desirably 3 $g/m^2$ or smaller, preferably 2 $g/m^2$ or smaller, in terms of silver amount.

Sensitizing dyes shown in, e.g., JP-A-63-159841 (the term "JP-A" as used herein means an "unexamined published Japanese patent application"), JP-A-60-140335, JP-A-63-23147, JP-A-63-259651, JP-A-63-394242, JP-A-63-15245, and U.S. * Patents 4,639,414, 4,740,455, 4,741,966, 4,751,175, and 4,835,096 can be used in the photothermographic material of the present invention.

The compound represented by formula (I) of the present invention is usable in ordinary silver halide photosensitive materials, which are not particularly limited as long as they have a photosensitive silver halide emulsion layer on a support.

The present invention will be explained below in more detail by reference to Examples, but the invention should not be construed as being limited thereto.

EXAMPLE 1

<Preparation of Photosensitive Emulsion A>

| | |
|---|---|
| Solution (1) | |
| Stearic acid | 135 g |
| Behenic acid | 635 g |
| Distilled water | 13 l |
| mixed at 85° C. for 15 min | |
| Solution (2) | |
| NaOH | 89 g |
| Distilled water | 1,500 ml |
| Solution (3) | |
| Concentrated $HNO_3$ | 21 ml |
| Distilled water | 50 ml |
| Solution (4) | |
| $AgNO_3$ | 365 g |
| Distilled water | 2,500 ml |
| Solution (5) | |
| Poly(vinyl butyral) | 86 g |
| Ethyl acetate | 4,300 ml |
| Solution (6) | |
| Poly(vinyl butyral) | 290 g |
| Isopropanol | 3,580 ml |
| Solution (7) | |
| N-Bromosuccinimide | 9.7 g |
| Acetone | 700 ml |

Solution (2) was added over a period of 5 minutes to solution (1) which was kept being vigorously agitated at a constant temperature of 85° C. Thereto was then added solution (3) over a period of 25 minutes. The resulting mixture was continuously stirred for 20 minutes and then cooled to 35° C. Solution (4) was added thereto over a period of 5 minutes with more vigorous agitation at 35° C. Subsequently, this mixture was continuously stirred for 90 minutes, following which solution (5) was added thereto. Stirring was then stopped, and the mixture was allowed to stand. The resulting aqueous layer was removed together with the salts contained therein to obtain an oil layer, from which the solvent was removed together with the water contained therein in a trace amount. To the residue was added solution (6). After this mixture was vigorously agitated at 50° C., solution (7) was added thereto over a period of 20 minutes. The resulting mixture was stirred for 105 minutes to obtain photosensitive emulsion A.

The layers specified below were formed in the following order on a biaxially stretched poly(ethylene terephthalate) support (with no primer layer) which had a thickness of 175 μm and had been colored in blue with tone regulator dye (d). Each coating fluid applied was dried at 75° C. for 5 minutes.

Tone regulator dye (d)

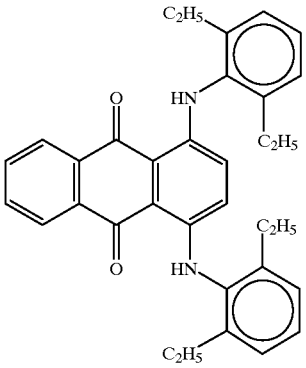

<Back Side Coating>

• Antihalation Layer (wet thickness, 80 μm)

| | |
|---|---|
| Poly(vinyl butyral) (10% isopropanol solution) | 150 ml |
| Antihalation dye (a) (0.2% DMF solution) | 70 ml |

Antihalation dye (a)

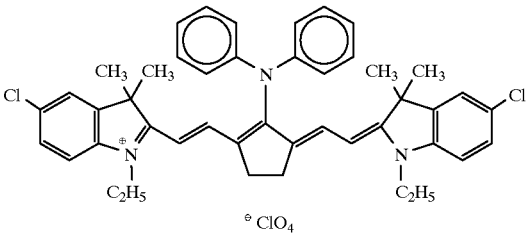

<Photosensitive Layer Side Coating>

• Photosensitive Layer (wet thickness, 140 μm)

| | |
|---|---|
| Photosensitive emulsion A | 73 g |
| Sensitizing dye 1 (0.1% DMF solution) | 2 ml |
| Antifoggant 1 (0.01% methanol solution) | 3 ml |
| Phthalazone (4.5% DMF solution) | 8 ml |
| Reducing agent 1 (10% acetone solution) | 13 ml |
| Compound | shown in Table 1 |

-continued

Sensitizing dye 1

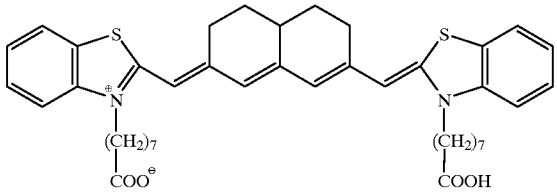

Antifoggant 1

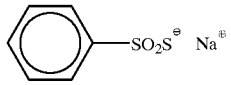

Phthalazone

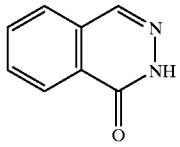

Reducing agent 1

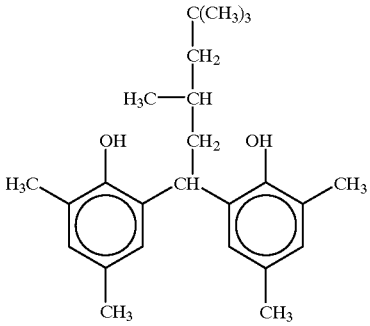

• Surface-protective Layer (wet thickness, 100 μm)

| | |
|---|---|
| Acetone | 175 ml |
| 2-Propanol | 40 ml |
| Methanol | 15 ml |
| Cellulose acetate | 8.0 g |
| Phthalazine | 1.0 g |
| 4-Methylphthalic acid | 0.72 g |
| Tetrachlorophthalic acid | 0.22 g |
| Tetrachlorophthalic anhydride | 0.5 g |

Phthalazine

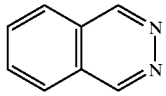

4-Methylphthalic acid

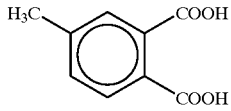

-continued

Tetrachlorophthalic acid

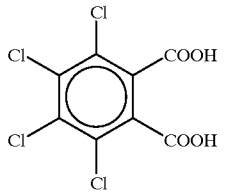

development with a heated drum under the conditions of 120° C. and 15 seconds and of 125° C. and 15 seconds. The samples were then examined to measure the fogging value. Further, the maximum density for each sample was evaluated in terms of relative value, with the maximum density for Sample No. 1 in Table 1 being taken as 100.

Evaluation of Storage Stability

Three coated samples were placed in a sealed container the atmosphere in which was kept at 25° C. and 55%. This container was allowed to stand at 50° C. for 7 days (forced aging). Thereafter, the second sample of these three was subjected to the same treatment as the evaluation of photographic properties together with an aged reference sample (stored in a light-shielded container at room temperature) to measure the density of fogged parts.

(Increase in fogging)=(Fogging after forced aging)−(Fogging in aged reference)

The results obtained are shown in Table 1.

TABLE 1

| Sample No. | Compound Formula (I) (amount mmol/m$^2$) | | Development fogging 120° C. × 15 sec | 125° C. × 15 sec. | Maximum density, relative value | Storage stability (increase in fogging) 120° C. × 15 sec | Remarks |
|---|---|---|---|---|---|---|---|
| 1 | — | | 0.16 | 0.23 | 100 | 0.20 | comparative |
| 2 | Comparative compound a | (0.8) | 0.14 | 0.17 | 70 | 0.10 | comparative |
| 3 | Comparative compound b | (0.8) | 0.13 | 0.14 | 63 | 0.06 | comparative |
| 4 | Comparative compound c | (0.8) | 0.13 | 0.13 | 66 | 0.03 | comparative |
| 5 | Comparative compound c | (1.6) | 0.12 | 0.12 | 63 | 0.02 | comparative |
| 6 | Comparative compound d | (0.8) | 0.13 | 0.13 | 67 | 0.04 | comparative |
| 7 | Comparative compound d | (1.6) | 0.12 | 0.13 | 65 | 0.03 | comparative |
| 8 | Exemplified compound I-1 | (0.8) | 0.13 | 0.15 | 90 | 0.03 | present invention |
| 9 | Exemplified compound I-1 | (1.6) | 0.12 | 0.15 | 88 | 0.02 | present invention |
| 10 | Exemplified compound I-4 | (0.8) | 0.13 | 0.15 | 93 | 0.04 | present invention |
| 11 | Exemplified compound I-4 | (1.6) | 0.12 | 0.14 | 89 | 0.03 | present invention |
| 12 | Exemplified compound I-5 | (0.8) | 0.13 | 0.14 | 91 | 0.03 | present invention |
| 13 | Exemplified compound I-5 | (1.6) | 0.12 | 0.13 | 88 | 0.02 | present invention |
| 14 | Exemplified compound I-8 | (0.8) | 0.13 | 0.14 | 90 | 0.03 | present invention |
| 15 | Exemplified compound I-8 | (1.6) | 0.12 | 0.12 | 86 | 0.02 | present invention |
| 16 | Exemplified compound I-15 | (0.8) | 0.13 | 0.16 | 88 | 0.04 | present invention |
| 17 | Exemplified compound I-15 | (1.6) | 0.13 | 0.15 | 85 | 0.02 | present invention |
| 18 | Exemplified compound I-21 | (0.8) | 0.14 | 0.16 | 87 | 0.04 | present invention |
| 19 | Exemplified compound I-47 | (0.8) | 0.13 | 0.15 | 92 | 0.04 | present invention |
| 20 | Exemplified compound I-47 | (1.6) | 0.12 | 0.13 | 90 | 0.03 | present invention |
| 21 | Exemplified compound I-50 | (0.8) | 0.13 | 0.14 | 90 | 0.03 | present invention |
| 22 | Exemplified compound I-50 | (1.6) | 0.11 | 0.12 | 88 | 0.02 | present invention |

-continued

Tetrachlorophthalic anhydride

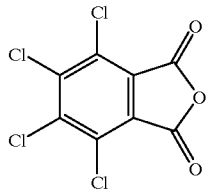

Sensitometry

The photothermographic materials thus produced were cut into the half size, and then exposed with an 830 nm laser diode in such a manner that the laser beam struck on each photosensitive material at an angle of 13° with a plane perpendicular to the photosensitive material. The exposed photosensitive material samples were subjected to heat Table 1 shows that the photosensitive material samples according to the present invention had sufficient sensitivity and were reduced in fogging, and that they also had satisfactory storage stability.

EXAMPLE 2

<Preparation of Silver Halide Grains A>

Into 700 ml of water were dissolved 16 g of a phthalated gelatin and 30 mλ of potassium bromide. After the pH of the solution was adjusted to 5.0 at 35° C., 159 ml of an aqueous solution containing 18.6 g of silver nitrate and an aqueous solution containing potassium bromide and potassium iodide (92/8) were added thereto by the controlled double jet method over a period of 10 minutes while maintaining the pAg at 7.7. Subsequently, 476 ml of an aqueous solution containing 55.4 g of silver nitrate and an aqueous solution containing potassium bromide were added thereto over a period of 30 minutes while maintaining the pAg at 7.7. The pH was lowered to cause precipitation and conduct desalting. Thereafter, 0.1 g of phenoxyethanol was added to adjust the pH to 7.9 and the pAg to 8.2 to complete the preparation of silver iodobromide grains A (core, 8 mol %; average, 2 mol %; 0.05 pm cubes; coefficient of variation of projected diameter area, 8%; proportion of (100) faces, 88%).

Silver halide grains A were heated to 60° C. Thereto were added sodium thiosulfate, selenium compound S-1, tellurium compound T-1, chloroauric acid, and potassium thiocyanate. After ripening was conducted for 120 minutes, the mixture was rapidly cooled to 35° C. to complete chemical sensitization. Thus, silver halide grains were prepared. The addition amounts of those compounds are as follows.

| | |
|---|---|
| Sodium thiosulfate | $8.5 \times 10^{-5}$ mol/mol-Ag |
| Selenium compound S-1 | $1.1 \times 10^{-5}$ mol/mol-Ag |
| Tellurium compound T-1 | $1.5 \times 10^{-5}$ mol/mol-Ag |
| Chloroauric acid | $3.5 \times 10^{-6}$ mol/mol-Ag |
| Potassium thiocyanate | $2.7 \times 10^{-4}$ mol/mol-Ag |

Selenium compound S-1

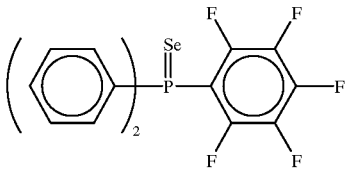

Tellurium compound T-1

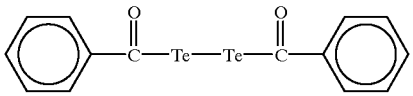

<Preparation of Organic-fatty-acid/silver emulsion B>

To 300 ml of water was added 10.6 g of behenic acid. This mixture was heated to 90° C. to dissolve the acid. Thereto was added, with sufficient stirring, 31.1 ml of 1 N sodium hydroxide. The resulting mixture was allowed to stand in that state for 1 hour. Thereafter, the mixture was cooled to 30° C., and 7.0 ml of 1 N phosphoric acid was added. Thereto was added, with sufficient stirring, 0.01 g of N-bromosuccnimide. Silver halide grains A prepared beforehand were added to the resulting mixture with stirring at 40° C. in an amount of 10 mol % in terms of silver amount based on the amount of behenic acid. Further, 25 ml of 1 N aqueous silver nitrate solution was added continuously thereto over a period of 2 minutes, and the resulting mixture was continuously stirred for 1 hour.

To this water-based mixture was gradually added, with stirring, 37 g of a 1.2 wt% butyl acetate solution of poly (vinyl acetate) to floc suspended particles. Thereafter, the water was removed, and the residue was washed twice with water (conductance of washing water, 30 $\mu$S/cm). Thereto was added 20 cc of a 2.5 wt % 2-butanone solution of poly(vinyl butyral) (molecular weight, 3,000). This mixture was stirred at a sufficient speed for 10 minutes. Subsequently, the following compounds, 40 g of 2-butanone, and 6.0 g of poly(vinyl butyral) (molecular weight, 4,000) were added, and the resulting mixture was stirred at a sufficient speed for 1 hour to complete the preparation of organic-fatty-acid/silver emulsion B.

Antifoggant 2

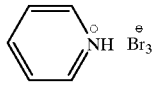

4.3 mmol/mol-Ag

| | |
|---|---|
| Calcium bromide $CaBr_2$ | 6.5 mmol/mol-Ag |

<Preparation of Emulsion Coating Fluid>

The following chemicals were added to the thus-prepared organic-fatty-acid/silver to obtain an emulsion coating fluid. (The following addition amounts are per mol of silver).

| | |
|---|---|
| Isocyanate (N3300, manufactured by Desmodur Co.) | 2.6 g |
| Sensitizing dye 2 | 0.01 mmol |
| Sensitizing dye 3 | 0.01 mmol |
| 2-Mercapto-5-methylbenzimidazole | 7.65 mmol |
| p-Chlorobenzoylbenzoic acid | 53 mmol |
| Reducing agent 1 | 0.27 mmol |
| Tetrachlorophthalic acid | 10.8 mmol |
| Coating aid 1 | 0.001 mmol |
| Compound | shown in Table 2 |

Sensitizing dye 2

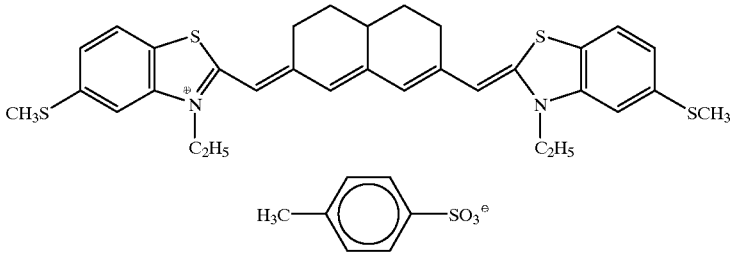

Sensitizing dye 3

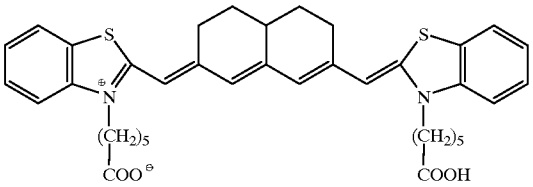

Tetrachlorophthalic acid

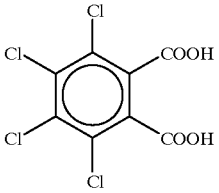

2-Mercapto-5-methylbenzimidazole

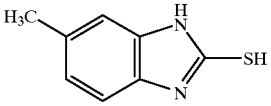

Coating aid 1

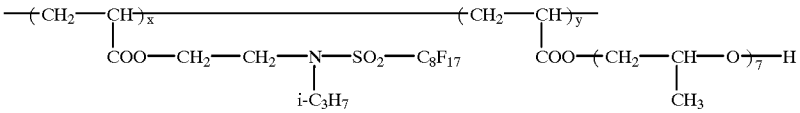

$x/y$ = 40/60 (by weight)
weight-average molecular weight, 15,000 p-Chlorobenzoylbenzoic acid

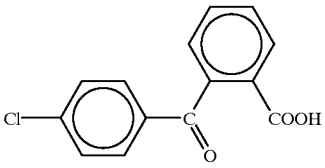

Reducing agent 1

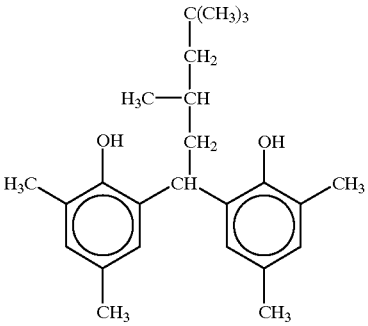

<Preparation of Coating Fluid for Surface-protective Layer>

A coating fluid for forming a surface-protective layer was prepared as follows.

| | | |
|---|---|---|
| Cellulose acetate butyrate | 7.5 | g |
| 2-Butanone | 80 | g |
| Methanol | 10 | g |
| Phthalazine | 71.5 | mmol |
| 4-Methylphthalic acid | 0.3 | g |
| Tetrachlorophthalic anhydride | 0.07 | g |
| Coating aid 1 | 0.01 | g |

Phthalazine

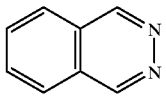

4-Methylphthalic acid

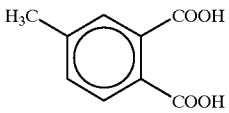

Tetrachlorophthalic anhydride

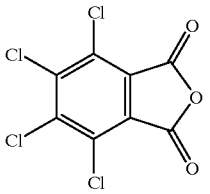

Coating aid 1

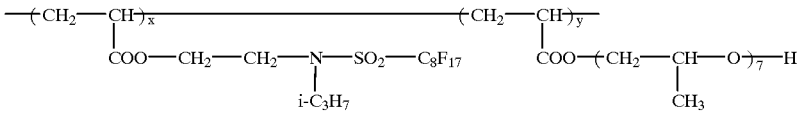

$x/y$ = 40/60 (by weight)
weight-average molecular weight, 15,000

<Preparation of Coating Fluid for Backing Layer>

A coating fluid for forming a backing layer was prepared as follows.

| | | |
|---|---|---|
| Poly(vinyl butyral) (10% 2-butanone solution) | 30 | ml |
| Cellulose acetate butyrate (10% ethyl acetate solution) | 30 | ml |
| Antihalation dye (b) | 0.05 | g |
| Antihalation dye (c) | 0.06 | g |
| Tone regulator dye (d) | 0.1 | g |
| Tone regulator dye (e) | 0.002 | g |
| Silica matting agent (Sailoid 162) | 0.1 | g |
| Isocyanate (N3300, manufactured by Desmodur Co.) | 0.8 | g |
| Ethyl acetate | 140 | ml |
| Coating aid 1 | 0.1 | g |

Antihalation dye (b)

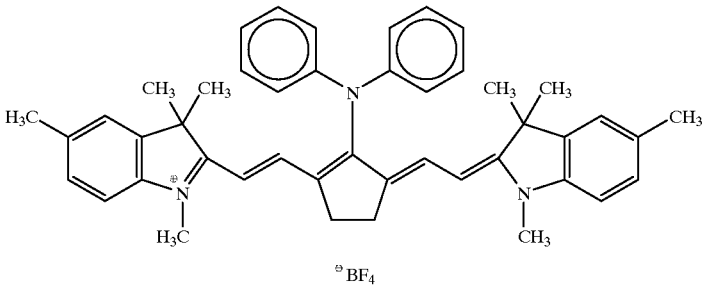

Antihalation dye (c)

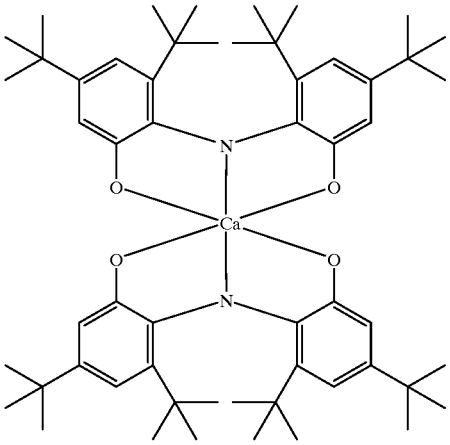

Tone regulator dye (d)

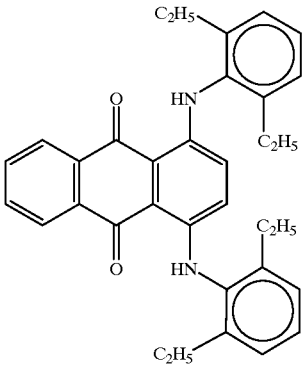

Tone regulator dye (e)

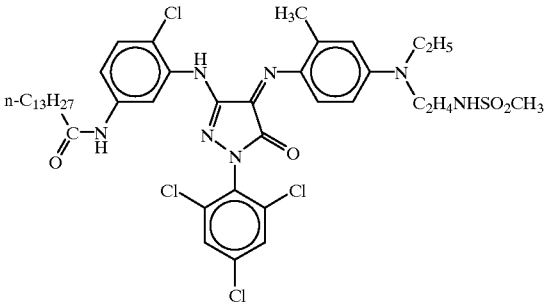

Coating aid 1

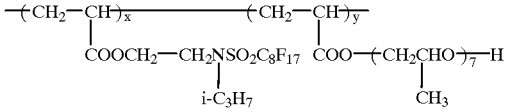

$x/y$ = 40/60 (by weight)
weight-average molecular weight, 15,000

The coating fluid for backing layer thus prepared was applied to a biaxially stretched poly(ethylene terephthalate) film which had a thickness of 175 $\mu$m and had been colored in blue, in such an amount as to result in an 810 nm absorbance higher by 1.2 than the poly(ethylene terephthalate) film.

(Production of Coated Sample)

The emulsion coating fluid prepared was applied to the poly(ethylene terephthalate) film on the side opposite to the backing layer in an amount of 2.0 g/m$^2$ in terms of silver amount, and the coating was dried. Thereafter, the coating fluid for surface-protective layer was applied in an amount of 2.5 g/m$^2$ in terms of cellulose acetate butyrate amount. Thus, coated sample 1 was produced.

<Evaluation of Photographic Performance>

Sensitometry

The photothermographic materials thus produced were cut into the half size, and then image-wise exposed with an 810 nm semiconductor laser produced by modifying FCR7000, manufactured by Fuji Photo Film Co., Ltd., in such a manner that the laser beam struck on each coated sample at an angle of 80°. The laser had an output of 150 mW, provided that high-frequency superimposition and a vertical multi-mode were used for output. Heat development was conducted by evenly heating the exposed samples with a heated drum in two ways, i.e., at 120° C. for 15 seconds and at 125° C. for 15 seconds. The samples were then examined to measure the fogging value. Further, the maximum density for each sample was evaluated in terms of relative value, with the maximum density for Sample No. 1 in Table 2 being taken as 100.

Evaluation of Storage Stability

Storage stability was evaluated in the same manner as in Example 1 as follows. Three coated samples were placed in a sealed container the atmosphere in which was kept at 25° C. and 55%. This container was allowed to stand at 50° C. for 7 days (forced aging). Thereafter, the second sample of these three was subjected to the same treatment as the evaluation of photographic properties together with an aged reference sample (stored in a light-shielded container at room temperature) to measure the density of fogged parts.

(Increase in fogging)=(Fogging after forced aging)−(Fogging in aged reference)

The results obtained are shown in Table 2.

TABLE 2

| Sample No. | Compound Formula (I) (amount mmol/mol-Ag) | | Development fogging 120° C. × 15 sec | 125° C. × 15 sec. | Maximum density, relative value | Storage stability (increase in fogging) 120° C. × 15 sec | Remarks |
|---|---|---|---|---|---|---|---|
| 1 | — | | 0.15 | 0.22 | 100 | 0.18 | comparative |
| 2 | Comparative compound a | (12.5) | 0.14 | 0.16 | 74 | 0.09 | comparative |
| 3 | Comparative compound b | (12.5) | 0.12 | 0.14 | 67 | 0.05 | comparative |
| 4 | Comparative compound c | (12.5) | 0.12 | 0.13 | 68 | 0.04 | comparative |
| 5 | Comparative compound c | (25.0) | 0.11 | 0.12 | 65 | 0.03 | comparative |
| 6 | Conparative compound d | (12.5) | 0.13 | 0.14 | 67 | 0.05 | comparative |
| 7 | Comparative compound d | (25.0) | 0.12 | 0.13 | 65 | 0.03 | comperative |
| 8 | Exemplified compound I-1 | (12.5) | 0.13 | 0.15 | 90 | 0.03 | present invention |
| 9 | Exemplified compound I-1 | (25.0) | 0.12 | 0.13 | 88 | 0.02 | present invention |
| 10 | Exemplified compound I-4 | (12.5) | 0.13 | 0.15 | 93 | 0.03 | present invention |
| 11 | Exemplified compound I-4 | (25.0) | 0.12 | 0.14 | 90 | 0.02 | present invention |
| 12 | Exemplified compound I-5 | (12.5) | 0.12 | 0.14 | 91 | 0.02 | present invention |
| 13 | Exemplified compound I-5 | (25.0) | 0.11 | 0.12 | 88 | 0.02 | present invention |
| 14 | Exemplified compound I-8 | (12.5) | 0.12 | 0.13 | 92 | 0.03 | present invention |
| 15 | Exemplified compound I-8 | (25.0) | 0.11 | 0.12 | 89 | 0.02 | present invention |
| 16 | Exemplified compound I-15 | (12.5) | 0.13 | 0.15 | 89 | 0.04 | present invention |
| 17 | Exemplified compound I-15 | (25.0) | 0.13 | 0.14 | 86 | 0.02 | present invention |
| 18 | Exemplified compound I-35 | (12.5) | 0.13 | 0.14 | 93 | 0.03 | present invention |
| 19 | Exemplified compound I-35 | (25.0) | 0.11 | 0.12 | 90 | 0.02 | present invention |
| 20 | Exemplified compound I-42 | (12.5) | 0.11 | 0.13 | 93 | 0.03 | present invention |
| 21 | Exemplified compound I-42 | (25.0) | 0.10 | 0.11 | 90 | 0.02 | present invention |
| 22 | Exemplified compound I-54 | (12.5) | 0.13 | 0.14 | 92 | 0.04 | present invention |
| 23 | Exemplified compound I-54 | (25.0) | 0.12 | 0.14 | 91 | 0.02 | present invention |

Table 2 shows that as in Example 1, the photosensitive material samples according to the present invention had sufficient sensitivity and were reduced in fogging, and that they also had satisfactory storage stability.

As demonstrated above, the photosensitive material of the present invention has high sensitivity and is reduced in fogging. Further, the sensitive material has satisfactory storage stability.

While the invention has been described in detail and with reference to specific embodiments thereof, it will be apparent to one skilled in the art that various changes and modifications can be made therein without departing from the spirit and scope thereof.

What is claimed is:

1. A silver halide photosensitive material which contains at least one silver halide emulsion layer and a polyhalomethane compound represented by formula (I-b):

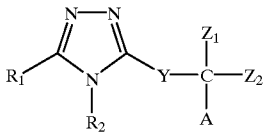

wherein $R_1$ is a hydrogen atom, alkyl group, alkenyl group, alkynyl group, aryl group, alkoxy group, aryloxy group, acylamino group, alkoxycarbonylamino group, aryloxycarbonylamino group, sulfonylamino group, ureido group, phosphoric acid amide group, or a heterocyclic group;

$R_2$ is an alkyl group, alkenyl group, alkynyl group, aryl group, alkoxy group, aryloxy group, acylamino group, alkoxycarbonylamino group, aryloxycarbonylamino group, sulfonylamino group, ureido group, phosphoric acid amide group, or a heterocyclic group;

$Z_1$ and $Z_2$ each represents a halogen atom;

Y represents —C(=O)—, —SO— or —$SO_2$—; and

A represents a hydrogen atom or an electron-withdrawing group, said electron-withdrawing group having a $\sigma_p$ value of 0.01 or higher.

2. The silver halide photosensitive material as claimed in claim 1, wherein the polyhalomethane compound represented by formula (I) is used in an amount of $10^{-4}$ mol to 1 mol/mol-Ag.

3. The silver halide photosensitive material of claim 1, wherein said polyhalomethane is represented by Formula (I-d):

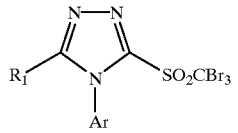

wherein $R_1$ has the same meaning as in claim 1 and Ar is a substituted or unsubstituted aryl group.

4. The silver halide photosensitive material as claimed in claim 1, wherein the polyhalomethane compound represented by the Formula (I) is present in an amount of $10^{-3}$ mol to 0.3 mol/mol-Ag.

5. The silver halide photosensitive material according to claim 1, wherein said electron-withdrawing group is selected from the group consisting of (1) a halogen atom;

(2) a trihalomethyl group;

(3) a cyano group;

(4) a nitro group;

(5) an aliphatic, aryl or heterocyclic sulfonyl group;

(6) an aliphatic, aryl or heterocyclic acyl group;

(7) an alkynyl group;

(8) an aliphatic, aryl, or heterocyclic oxycarbonyl group;

(9) a carbamoyl group; and

(10) a sulfamoyl group.

6. The silver halide photosensitive material according to claim 5, wherein said halogen atom (1) is selected from the group consisting of fluorine, chlorine, bromine and iodine;

said trihalomethyl group (2) is selected from the group consisting of tribromomethyl, trichloromethyl and trifluoromethyl;

said sulfonyl group (5) is methanesulfonyl;

said acyl group (6) is selected from the group consisting of acetyl and benzoyl;

said alkynyl group (7) is ethynyl; and said oxycarbonyl group (8) is methoxycarbonyl or phenoxycarbonyl.

7. The silver halide photosensitive material according to claim 5, wherein said electron-withdrawing group is a halogen atom.

8. The silver halide photosensitive material according to claim 7, wherein said electron-withdrawing group is a bromine atom.

9. A photothermographic material which contains (a) a reducible silver salt, (b) a reducing agent, (c) a photocatalyst, (d) a binder, and (e) a polyhalomethane compound

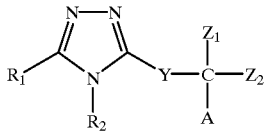

wherein $R_1$ is a hydrogen atom, alkyl group, alkenyl group, alkynyl group, aryl group, alkoxy group, aryloxy group, acylamino group, alkoxycarbonylamino group, aryloxycarbonylamino group, sulfonylamino group, ureido group, phosphoric acid amide group, or a heterocyclic group;

$R_2$ is an alkyl group, alkenyl group, alkynyl group, aryl group, alkoxy group, aryloxy group, acylamino group, alkoxycarbonylamino group, aryloxycarbonylamino group, sulfonylamino group, ureido group, phosphoric acid amide group, or a heterocyclic group;

$Z_1$ and $Z_2$ each represents a halogen atom;

Y represents —C(=O)—, —SO— or —$SO_2$—; and

A represents a hydrogen atom or an electron-withdrawing group, said electron-withdrawing group having a up value of 0.01 or higher.

10. The photothermographic material as claimed in claim 9, wherein at least one of said silver halide emulsion layer of said photographic material is sensitized in the infrared region for exposure to an infrared laser beam.

11. The photothermographic material as claimed in claim 9, wherein the polyhalomethane compound represented by formula (I) is used in an amount of $10^{-4}$ mol to 1 mol/mol-Ag.

12. The photothermographic material of claim 9, wherein said polyhalomethane is represented by Formula (I-d):

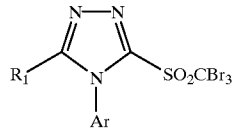

wherein $R_1$ has the same meaning as in claim 1 and Ar is a substituted or unsubstituted aryl group.

13. The photothermographic material as claimed in claim 9, wherein the polyhalomethane compound represented by Formula (I) is present in an amount of $10^{-3}$ mol to 0.3 mol/mol-Ag.

* * * * *